US007699102B2

(12) United States Patent
Storm et al.

(10) Patent No.: US 7,699,102 B2
(45) Date of Patent: Apr. 20, 2010

(54) RECHARGEABLE ENERGY STORAGE DEVICE IN A DOWNHOLE OPERATION

(75) Inventors: Bruce H Storm, Houston, TX (US); Roger L. Schultz, Aubrey, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 434 days.

(21) Appl. No.: 11/292,943

(22) Filed: Dec. 2, 2005

(65) Prior Publication Data

US 2006/0191681 A1 Aug. 31, 2006

Related U.S. Application Data

(60) Provisional application No. 60/633,180, filed on Dec. 3, 2004.

(51) Int. Cl.
*E21B 41/00* (2006.01)

(52) U.S. Cl. ..... 166/244.1; 166/302; 166/65.1

(58) Field of Classification Search ..... 166/57, 166/302, 65.1, 244.1; 73/152.13
See application file for complete search history.

(56) References Cited

U.S. PATENT DOCUMENTS

| | | | |
|---|---|---|---|
| 2,930,137 | A | 3/1960 | Arps |
| 4,134,462 | A | 1/1979 | Clay |
| 4,164,253 | A | 8/1979 | Skala |
| 4,375,157 | A | 3/1983 | Boesen |
| 4,400,858 | A | 8/1983 | Goiffon et al. |
| 4,403,645 | A | 9/1983 | MacCracken |
| 4,407,136 | A | 10/1983 | de Kanter |
| 4,416,000 | A | 11/1983 | Scherbatskoy |
| 4,449,164 | A | 5/1984 | Carlson et al. |
| 4,537,067 | A | 8/1985 | Sharp et al. |
| 4,945,775 | A | 8/1990 | Adams et al. |
| 4,987,684 | A | 1/1991 | Andreas et al. |
| 5,159,972 | A | 11/1992 | Gunnerson et al. |
| 5,165,243 | A | 11/1992 | Bennett |
| 5,456,081 | A | 10/1995 | Chrysler et al. |
| 5,458,200 | A | 10/1995 | Lagerlef et al. |
| 5,701,751 | A | 12/1997 | Flores |
| 5,713,208 | A | 2/1998 | Chen et al. |
| 5,727,618 | A | 3/1998 | Mundinger et al. |
| 5,737,923 | A | 4/1998 | Gilley et al. |

(Continued)

FOREIGN PATENT DOCUMENTS

| | | |
|---|---|---|
| GB | 2197538 | 5/1988 |

(Continued)

OTHER PUBLICATIONS

*International Search Report—PCT/US2005/043663*, Authorized Officer—Manolache, I,(Dec. 2, 2005), 6 pages.

(Continued)

*Primary Examiner*—Shane Bomar
(74) *Attorney, Agent, or Firm*—Schwegman, Lundberg & Woessner, P.A.

(57) ABSTRACT

In some embodiments, an apparatus includes a tool for a downhole operation. The tool includes an electrical component. The tool includes a rechargeable energy storage device to supply power to the electrical component. The tool also includes a generator to supply power to the electrical component.

16 Claims, 17 Drawing Sheets

U.S. PATENT DOCUMENTS

| | | | |
|---|---|---|---|
| 5,771,984 | A | 6/1998 | Potter et al. |
| 5,901,037 | A | 5/1999 | Hamilton et al. |
| 5,934,082 | A | 8/1999 | Steinmeyer |
| 5,977,785 | A | 11/1999 | Burward-Hoy |
| 6,084,770 | A | 7/2000 | Wyland |
| 6,178,088 | B1 | 1/2001 | Gates |
| 6,200,536 | B1 | 3/2001 | Tonkovich et al. |
| 6,201,221 | B1 | 3/2001 | LaGrotta et al. |
| 6,341,498 | B1 | 1/2002 | DiFoggio |
| 6,411,512 | B1 | 6/2002 | Mankaruse et al. |
| 6,415,612 | B1 | 7/2002 | Pokharna et al. |
| 6,432,497 | B2 | 8/2002 | Bunyan |
| 6,481,216 | B2 | 11/2002 | Simmons et al. |
| 6,501,654 | B2 | 12/2002 | O'Connor et al. |
| 6,519,955 | B2 | 2/2003 | Marsala |
| 6,539,725 | B2 | 4/2003 | Bell |
| 6,557,354 | B1 | 5/2003 | Chu et al. |
| 6,590,770 | B1 | 7/2003 | Rogers et al. |
| 6,644,395 | B1 | 11/2003 | Bergin |
| 6,687,126 | B2 | 2/2004 | Patel et al. |
| 6,766,817 | B2 | 7/2004 | da Silva |
| 6,769,487 | B2 | 8/2004 | Hache |
| 6,799,429 | B2 | 10/2004 | Drube et al. |
| 6,834,671 | B2 | 12/2004 | Cotte et al. |
| 6,837,105 | B1 | 1/2005 | DiFoggio et al. |
| 6,864,417 | B2 | 3/2005 | Bechis et al. |
| 7,258,169 | B2 | 8/2007 | Fripp et al. |
| 7,342,787 | B1 | 3/2008 | Bhatia |
| 7,423,876 | B2 | 9/2008 | Artman et al. |
| 2002/0033247 | A1 | 3/2002 | Neuschutz et al. |
| 2002/0039280 | A1 | 4/2002 | O'Connor et al. |
| 2002/0144811 | A1 | 10/2002 | Chou et al. |
| 2002/0159237 | A1 | 10/2002 | Patel et al. |
| 2002/0186531 | A1 | 12/2002 | Pokharna et al. |
| 2003/0061824 | A1 | 4/2003 | Marsala |
| 2003/0085039 | A1 | 5/2003 | DiFoggio |
| 2003/0097846 | A1 | 5/2003 | Novotny et al. |
| 2003/0116302 | A1 | 6/2003 | Sauciuc et al. |
| 2003/0136548 | A1 | 7/2003 | Parish et al. |
| 2003/0140636 | A1 | 7/2003 | Van |
| 2003/0151523 | A1 | 8/2003 | Skinner et al. |
| 2003/0152764 | A1 | 8/2003 | Bunyan et al. |
| 2003/0178177 | A1 | 9/2003 | Eytcheson et al. |
| 2003/0178178 | A1 | 9/2003 | Breuer et al. |
| 2003/0183375 | A1 | 10/2003 | Clarksean |
| 2004/0042176 | A1 | 3/2004 | Niwatsukino et al. |
| 2004/0055746 | A1 | 3/2004 | Ross |
| 2004/0079100 | A1 | 4/2004 | Monfarad |
| 2004/0237529 | A1 | 12/2004 | da Silva |
| 2005/0022404 | A1 | 2/2005 | Ash et al. |
| 2006/0101831 | A1 | 5/2006 | Storm et al. |
| 2006/0191682 | A1 | 8/2006 | Storm et al. |
| 2006/0191687 | A1 | 8/2006 | Storm et al. |

FOREIGN PATENT DOCUMENTS

| | | | |
|---|---|---|---|
| WO | WO-03067029 | A1 | 8/2003 |
| WO | WO-2006060673 | A1 | 6/2006 |

OTHER PUBLICATIONS

"Developed Micropump for water cooling system", http://www.skcj.co.ip/english/motor/micropumpe.html, (Archived Nov. 3, 2004), 2 pages.

"Heretic Program Overview", http://www.darpa.mil/MTO/HERETIC/overview.html *Defense Advanced Research Projects Agency* (*Darpa*), (Observed Sep. 3, 2002), 3 Pages.

"Micro Annular Gear Pumps", http://www.micropump.com/products/pumps/micro_annular/index.asp, *IDEX Corporatio*, (Archived Aug. 18, 2003), 2 Pages.

"Micro Pumps", http://www.directindustry.com/search/micro%20pumps.html, (Observed Jan. 18, 2005), 3 Pages.

"Pumps", *APT Micro and Dispensing Pumps*, http://www.iprocressmart.com/apt/pumps.htm, (Archived Oct. 17, 2001), 3 Pages.

"Single Phase Micro-Fluid Loop for Cooling of Microelectronic Devices", http://www.me.gatech.edu/yogendra.joshi/METTL/projects/current/wei/single_phase_micro.htm, Georgia Tech University, (Archived Jul. 13, 2002), 3 Pages.

"Smart Thermal Management Systems Based on Solid Liquid Phase Change Materials", http://www.me.gatech.edu/yogendra.joshi/METTL/projects/current/dong/dong.htm, (Archived Jul. 13, 2002), 3 Pages.3

"Ultra-Low Flow Pump utilizes external gear technology", *News Story*, http://news.thomasnet.com/fullstory/451530, 2 Pages.

"Ultrasonic Driven Minipump", *Microsystems*, http://www.europractice.com/technologies/microsystems/products/product_detail.asp?ID=17, (Archived Jan. 14, 2003), 2 Pages.

Gonzalez, Ulises F., et al., "Simulation of Mems Piezoelectric Micropump for Biomedical Applications", http://www.algor.com/news_pubs/tech_white_papers/MEMS_micropump/default.asp-?print..., (Observed Jan. 18, 2005), 1-13.

Meng, Ellis, et al., "Polymer MEMS for Micro Fluid Delivery Systems", *Department of Electrical Engineering California Institute of Technology*, 2 Pages.

Zhang, Lian, "Measurements and modeling of two-phase flow in microchannels with nearly constant heat flux boundary conditions", *Journal of Microelectromechanical Systems*, 11(1), (Feb. 2002), 12-19.

"U.S. Appl. No. 10/990,075, Response filed Jan. 22, 2008 to Final Office Action mailed Nov. 27, 2007", 19.

"U.S. Appl. No. 10/990,075 Non-Final Office Action mailed Apr. 18, 2008", OARN,12 pgs.

"U.S. Appl. No. 10/9990,075, Response filed Sep. 20, 2007 to Non-Final Office Action main in Jun. 27, 2007", 13.

"U.S. Appl. No. 10/990,075 Final Office Action mailed Nov. 27, 2007", FOAR,11 pgs.

"U.S. Appl. No. 11/293,041, Response filed Jul. 24, 2008 to Restriction Requirement mailed Mar. 25, 2008", 8 pgs.

"U.S. Appl. No. 11/293,041, Restriction Requirement mailed Mar. 25, 2008", 5 pgs.

"U.S. Appl. No. 11/293,868, Restriction Requirement mailed Oct. 4, 2007", 5 pgs.

"U.S. Appl. No. 11/293,868, Non-Final Office Action mailed Jun. 18, 2008", 5 pgs.

"U.S. Appl. No. 11/293,868, Notice of Allowance mailed Apr. 23, 2009", 6 pgs.

"U.S. Appl. No. 11/293,868, Response filed Apr. 4, 2008 to Restriction Requirement mailed Oct. 4, 2007", 8 pgs.

"U.S. Appl. No. 11/293,868, Response filed Dec. 18, 2008 to Non-Final Office Action mailed Jun. 18, 2008", 7 pgs.

"U.S. Appl. No. 11/293,868, Supplemental Notice of Allowability mailed Jun. 2, 2009", 4 pgs.

"International Application Serial No. PCT/US2005/043663, International Preliminary Report on Patentability mailed Apr. 26, 2007", 13 pgs.

"International Application Serial No. PCT/US2005/043663, International Search Report mailed Apr. 7, 2006", 4 pgs.

"International Application Serial No. PCT/US2005/043663, Written Opinion mailed Apr. 7, 2006", 7 pgs.

"U.S. Appl. No. 10/990,075 Final Office Action Mailed Oct. 27, 2009", 11 pgs.

"U.S. Appl. No. 11/293,041, Non Final Office Action mailed Jul. 27, 2009", 5 pgs.

"U.S. Appl. No. 11/293,868 Notice of Allowance Mailed Aug. 13, 2009", 6 pgs.

"U.S. Appl. No. 10/990,075, Response filed Jul. 21, 2009 to Non Final Office Action mailed Apr. 29, 2009", 8 pgs.

RECHARGEABLE ENERGY STORAGE DEVICE IN A DOWNHOLE OPERATION

CROSS-REFERENCE TO RELATED APPLICATIONS

The application claims priority under 35 U.S.C. § 119(e) of U.S. Provisional Application No. 60/633,180, filed Dec. 3, 2004, which application is incorporated herein by reference.

RELATED APPLICATIONS

This application is related to, entitled:, HEATING AND COOLING ELECTRICAL COMPONENTS IN A DOWNHOLE OPERATION, Ser. No. 11/293,041, filed Dec. 2, 2005; and, entitled: SWITCHABLE POWER ALLOCATION IN A DOWNHOLE OPERATION, Ser. No. 11/293,868, filed Dec. 2, 2005.

TECHNICAL FIELD

The application relates generally to petroleum recovery operations. In particular, the application relates to a configuration for use of electronics in downhole tools for such operations.

BACKGROUND

During drilling operations, Measurement-While-Drilling (MWD) and Logging-While-Drilling (LWD systems as well as wireline systems provide wellbore directional surveys, petrophysical well logs and drilling information to locate and extract hydrocarbons from below the surface of the Earth. Different tools used in these operations incorporate various electrical components. Examples of such tools include sensors for measuring different downhole parameters, data storage devices, flow control devices, transmitters/receivers for data communications, etc. Downhole temperatures can vary between low to high temperatures, which can adversely affect the operations of the electrical components.

SUMMARY

In some embodiments, an apparatus includes a tool for a downhole operation. The tool includes an electrical component. The tool includes a rechargeable energy storage device to supply power to the electrical component. The tool also includes a generator to supply power to the electrical component.

BRIEF DESCRIPTION OF THE DRAWINGS

Embodiments of the invention may be best understood by referring to the following description and accompanying drawings which illustrate such embodiments. The numbering scheme for the Figures included herein are such that the leading number for a given reference number in a Figure is associated with the number of the Figure. For example, a tool 100 can be located in FIG. 1. However, reference numbers are the same for those elements that are the same across different Figures. In the drawings.

DETAILED DESCRIPTION

Figure 1:
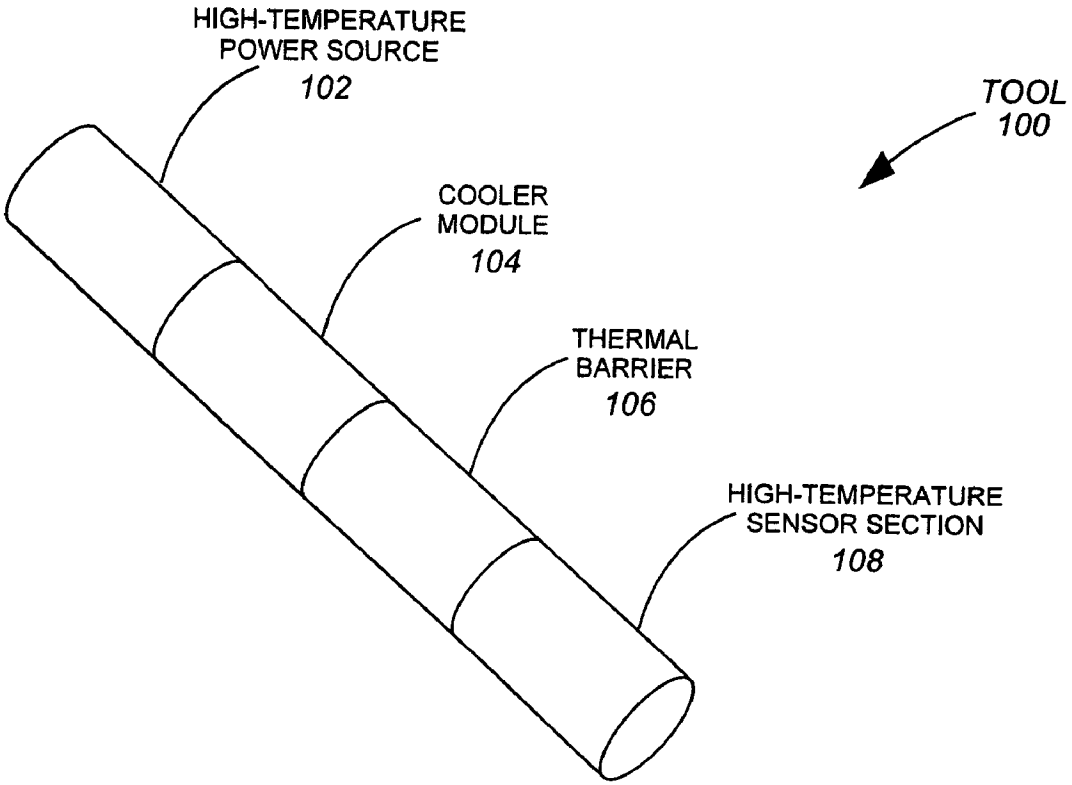
FIG. 1 illustrates a tool for downhole operations that includes a configuration for electrical components operable at high temperatures, according to some embodiments of the invention.

Methods, apparatus and systems for heating and cooling downhole are described. In the following description, numerous specific details are set forth. However, it is understood that embodiments of the invention may be practiced without these specific details. In other instances, well-known circuits, structures and techniques have not been shown in detail in order not to obscure the understanding of this description.

Some embodiments include configurations that have electrical components that are operable at high temperatures in combination with heat exhausting cooling systems. Some embodiments include different Commercial Off The Shelf (COTS) electronics (such as high density memory and microprocessors) that are enclosed in a thermally insulating container that may be cooled by a heat exhausting cooling system. The cooling system may include heat sinks, heat exchangers and other components for enhancing thermal energy transfer. Moreover, the configuration may include components capable of exhausting heat to the surrounding environment. For example, the tool pressure housing, drill string, etc. may be coupled to a heat sink, a heat exchanger, etc. to exhaust the heat. In some embodiments, certain electrical components may be operable at high temperatures. For example, the electrical components that are part of the power source (such as a flow-driven generator), the sensors, the telemetry components, etc. may be operable at high temperatures. Some embodiments allow the use of COTS microprocessors and memory downhole that are operable at low temperatures. Accordingly, the speed of processing may be greater and the density of the memory may be higher that can be obtained using high-temperature electrical components.

Some embodiments include a power generator that is switchably operated to provide power to both a heater and a cooler downhole. For example, if the temperature is low, some or all of the power may be switched to a heater that may be used to raise the temperature of an energy storage device. Conversely, if the temperature is high, some or all of the power may be switched to a cooler that may be used to lower the temperature of electronics.

Some embodiments include a rechargeable energy storage device, which may be used in combination with an alternative power source (such as a turbine generator powered by mud flow downhole). The rechargeable energy storage device may be operable a high temperatures. Rechargeable energy storage device operable at high temperatures exceed the operating temperature limit of standard energy storage devices (such as standard lithium batteries). Moreover, recharging the energy storage devices downhole may allow for a smaller storage device payload than would be required with non-rechargeable energy storage devices.

While described with reference to the removal of heat from electrical components, such embodiments may be used to remove heat from any type of component. For example, the component may be mechanical, electro-mechanical, etc. In the following description, the definition of high temperature and low temperature are defined for various components. Such definitions of temperature are relative to the component and may or may not be independent of temperatures of other components. For example, a high temperature for component A may be different than a high temperature for component B.

This description of the embodiments is divided into four sections. The first section describes a tool in a downhole operation. The second section describes different configurations for a switchably operated downhole power source for heating and cooling in a downhole tool. The third section describes different configurations using a rechargeable energy storage devices downhole. The fourth section describes example operating environments. The fifth section provides some general comments.

Downhole Tool Having Heating and/or Cooling

FIG. 1 illustrates a tool for downhole operations that includes a configuration for electrical components operable at high temperatures, according to some embodiments of the invention. In particular, FIG. 1 illustrates a tool 100 that may be representative of a downhole tool that is part of an MWD system, a tool body that is part of a wireline system, a temporary well testing tool, etc. Examples of such systems are described in more detail below (see description of FIGS. 10A-10B). The tool 100 includes a high-temperature power source 102, a cooler module 104, a thermal barrier 106 and a high-temperature sensor section 108.

In some embodiments, the cooler module 104 includes one or more heat exchangers or other components for thermal energy transfer. The heat exchangers may be parallel-flow heat exchangers, wherein two fluids enter an exchanger at a same end and travel the exchanger parallel relative to each other. The heat exchangers may be counter-flow heat exchangers wherein the two fluids enter an exchanger at opposite ends. The heat exchangers may also be cross-flow heat exchangers, plate heat exchangers, etc. The heat exchangers may be comprised of multiple layers of different materials, such as copper flow tubes with aluminum fins or plates. In some embodiments, the cooler module includes a thermoacoustic cooler which is capable of removing heat from one area of the tool, such as that area occupied by thermally sensitive electronics, and transferring this heat to some other area which is not as temperature sensitive.

The thermal barrier 106 may be a thermally insulating container. The thermal barrier 106 may house different electronics or electrical components. For example, the thermal barrier 106 may house electronics or electrical components that are operable at low temperatures. In some embodiments, such electronics or electrical components are COTS electronics. The high-temperature sensor section 108 includes one to a number of different sensors that include electrical components that are operable at high temperatures. Alternatively, some of the electrical components that are capable of operating at high temperature may be housed in the thermal barrier 106 and operable at low temperatures.

Figure 2:
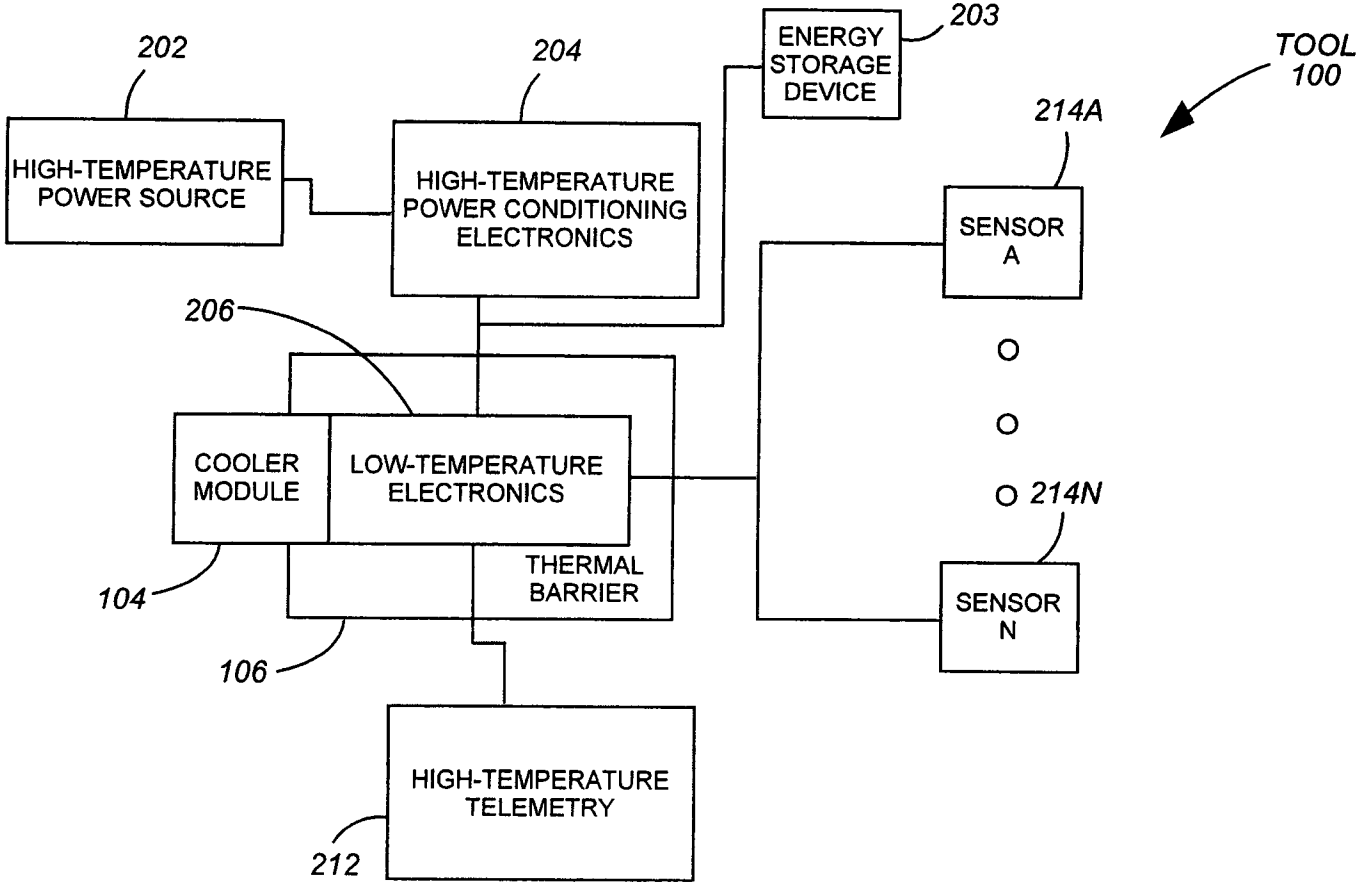
FIG. 2 illustrates a more detailed diagram of a tool for downhole operations that includes a configuration for electrical components operable at high temperatures, according to some embodiments of the invention.

FIG. 2 illustrates a more detailed diagram of a tool for downhole operations that includes a configuration for electrical components operable at high temperatures, according to some embodiments of the invention. In particular, FIG. 2 illustrates a more detailed block diagram of the tool 100. The tool 100 includes a high-temperature power source 202, high-temperature power conditioning electronics 204, an energy storage device 203, the cooler module 104, low-temperature electronics 206, the thermal barrier 106, high-temperature telemetry 212 and sensors 214A-214N. In some embodiments, not all of the components of the tool 100 illustrated in FIG. 2 are incorporated therein. For example, the tool 100 may not include the energy storage device 203. In another example, the tool 100 may not include the high-temperature telemetry 212.

The high-temperature power source 202 is coupled to the high-temperature power conditioning electronics 204. The high-temperature power source 202 may provide power to different electrical loads in the tool 100. For example, the different electrical loads may include the low-temperature electronics 206, the cooler module 104, the sensors 214A-214N, the high-temperature telemetry 212, the energy storage device 203, etc. The high-temperature power source 202 may be of different types. The high-temperature power source 202 may produce any power waveform including alternating current (AC) or direct current (DC). For example, the high-temperature power source 202 may be a flow-driven generator that derives its power from the mud flow in the borehole, a vibration-based generator, etc. The high-temperature power source 202 may be of the axial, radial or mixed flow type. In some embodiments, the high-temperature power source 108 may be driven by a positive displacement motor driven by the drilling fluid, such as a Moineau-type motor.

The high-temperature power conditioning electronics 204 may receive and condition the power from the high-temperature power source 202. The high-temperature power source 202 may be positioned near the sensors 214A-214N which may be near the drill bit of the drill string. The high-temperature power source 202 may be positioned further uphole near the repeaters that may be part of the telemetry system.

The high-temperature power source 202 and the high-temperature power conditioning electronics 204 may include electrical components that are operable at high temperatures. The electrical components may be composed of Silicon On Insulator (SOI), such as Silicon On Sapphire (SOS). In some embodiments, high temperatures in which the electrical components in the high-temperature power source 102 and the high-temperature power conditioning electronics 204 are operable include temperature above 150 degrees Celsius (° C.), above 175° C., above 200° C., above 220° C., in a range of 175-250° C., in a range of 175-250° C., etc.

The thermal barrier 106 hinders heat transfer from the outside environment to the electronics or electrical components housed in the thermal barrier 106. In some embodiments, the thermal barrier 106 may include an insulated vacuum flask, a vacuum flask filled with an insulating solid, a material-filled chamber, a gas-filled chamber, a fluid-filled chamber, or any other suitable barrier. In some embodiments, there may be a space between the thermal barrier 106 and the outside wall of the tool 100. This space may be evacuated, thereby hindering the heat transfer from outside the tool 100 to the electrical components within the thermal barrier 106. In some embodiments, the thermal barrier 106 may house the low-temperature electronics 206, at least part of the cooler module 104 and at least part of the sensors 214A-214N. The low temperatures at which these electrical components may be operable include temperatures below 150° C., below 175° C., below 200° C., below 220° C., below 125° C., below 100° C., below 80° C., in a range of 0-80° C., in a range of −20-100° C., etc.

In some embodiments, the sensors 214A-214N are composed of high-temperature electronics and are not housed in thermal barrier 106. Accordingly, the sensors 214A-214N may withstand direct contact with an environment at excessive temperatures. In some embodiments, at least part of the sensors 214A-214N have components not capable of operation at excessive environmental temperatures. In such a configuration, the thermally sensitive components of these sensors 214A-214N may be partially or totally enclosed in the thermal barrier 106. Alternatively or in addition, these thermally sensitive components of these sensors 214A-214N may be coupled to the cooler module 104. Therefore, these thermally sensitive components may be maintained at or below their operating temperatures. The sensors 214A-214N may be representative of any type of electronics or devices for sensing, control, data storage, telemetry, etc.

The sensors 214A-214N may be different types of sensors for measurement of different parameters and conditions downhole, including the temperature and pressure, the various characteristics of the subsurface formations (such as resistivity, porosity, etc.), the characteristics of the borehole (e.g., size, shape, etc.), etc. The sensors 214A-214N may also include directional sensors for determining direction of the borehole. The sensors 214A-214N may include electromagnetic propagation sensors, nuclear sensors, acoustic sensors, pressure sensors, temperature sensors, etc.

The electrical components within the high-temperature part of the sensors 214 may be composed of Silicon On Insulator (SOI), Silicon On Sapphire (SOS), Silicon Carbide, etc. In some embodiments, high temperatures in which the electrical components of the high-temperature parts of the sensors 214 are operable include temperature above 150 degrees Celsius (° C.), above 175° C., above 200° C., above 220° C., in a range of 175-250° C., in a range of 175-250° C., etc. In some embodiments, the low temperature at which the electrical components of the low-temperature parts of the sensors are operable includes temperature below 150° C., below 175° C., below 200° C., below 220° C., below 125° C., below 100° C., below 80° C., in a range of 0-80° C., in a range of −20-100° C., etc. In some embodiments, high temperatures in which the electrical components of the high-temperature telemetry 212 are operable include temperature above 150 degrees Celsius (° C.), above 175° C., above 200° C., above 220° C., in a range of 175-250° C., in a range of 175-250° C., etc.

Power may be supplied to the cooler module 104 from the high-temperature power source 202. Alternatively or in addition, power may be supplied to the cooler module 104 directly from the flow of the fluid in the borehole. If the cooler module 104 is driven by the fluid flow, a magnetic torque coupler may be used to avoid the use of dynamic seals by allowing mechanical coupling through a mechanical fluid barrier. This arrangement provides for direct mechanical powering of the cooler. Additionally, mechanical power provided by the fluid flow may be used to drive a hydraulic or pneumatic pump which can then be used to drive a hydraulic or pneumatic motor or other components to provide the mechanical drive for the cooler. In some embodiments, the cooler module 104 may include a thermoacoustic cooler. A thermoacoustic cooler typically operates at substantially the same speed, while the fluid flow rate may vary significantly. Therefore, a variable speed clutch may be used to provide a constant rotation rate to the cooler module 104. The variable speed clutch may have a mechanical transmission or may use a variable rheological fluid, such as magnetorheological fluid. Additionally, the rotation rate may be varied by changing the angle of the fin on the blades of the generator in the fluid flow. At high flow rates, a brake may be used to limit the rotation speeds of the blades. The power from the high-temperature power source 202 may be electrical and/or mechanical. For example, the cooler module 104 may be powered directly with mechanical energy. In other words, the fluid flow may cause mechanical motion, which provides the power to the cooler module 104. Alternatively or in addition, the fluid flow may cause mechanical motion that generates electrical energy that generates mechanical motion, which provides the power to the cooler module 104.

The energy storage device 203 may be any energy storage device suitable for providing power to downhole tools. Examples of energy storage devices include a primary (i.e., non-rechargeable) battery such as a voltaic cell, a lithium battery, a molten salt battery, or a thermal reserve battery, a secondary (i.e., rechargeable) battery such as a molten salt battery, a solid-state battery, or a lithium-ion battery, a fuel cell such as a solid oxide fuel cell, a phosphoric acid fuel cell, an alkaline fuel cell, a proton exchange membrane fuel cell, or a molten carbonate fuel cell, a capacitor, a heat engine such as a combustion engine, and combinations thereof. The foregoing energy storage devices are well known in the art. Suitable batteries are disclosed in U.S. Pat. No. 6,672,382 (describes voltaic cells), U.S. Pat. Nos. 6,253,847, and 6,544,691 (describes thermal batteries and molten salt rechargeable batteries), each of which is incorporated by reference herein in its entirety. Suitable fuel cells for use downhole are disclosed in U.S. Pat. Nos. 5,202,194 and 6,575,248, each of which is incorporated by reference herein in its entirety. Additional disclosure regarding the use of capacitors in wellbores can be found in U.S. Pat. Nos. 6,098,020 and 6,426,917, each of which is incorporated by reference herein in its entirety. Additional disclosure regarding the use of combustion engines in wellbores can be found in U.S. Pat. No. 6,705,085, which is incorporated by reference herein in its entirety.

The energy storage device 203 may provide power to different electrical loads in the tool 100. For example, the different electrical loads may include the low-temperature electronics 102, the cooling system 104, the sensors 114A-114N, the high-temperature telemetry 112, etc. The energy storage device 203 may have relatively high minimum operating temperatures, which are commonly determined and provided by suppliers and/or manufacturers of energy storage devices. By way of example, the minimum operating temperatures of some high-temperature energy storage devices are as follows: a sodium/sulfur molten salt battery (typically a secondary battery) operates at from about 290° C. to about 390° C.; a sodium/metal chloride (e.g., nickel chloride) molten salt battery (typically a secondary battery) operates at from about 220° C. to about 450° C.; a lithium aluminum/iron disulfide molten salt battery operates near about 500° C.; a calcium/calcium chromate battery operates near about 300° C.; a phosphoric acid fuel cell operates at from about 150° C. to about 250° C.; a molten carbonate fuel cell operates at from about 650° C. to about 800° C.; and a solid oxide fuel cell operates at from about 800° C. to about 1,000° C.

Figure 3B:
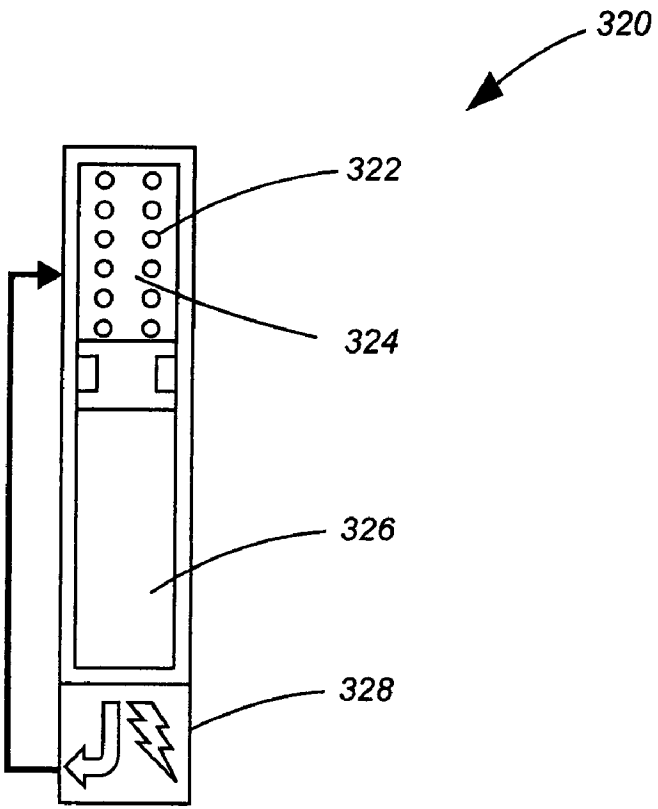
FIGS. 3A-3B illustrate mechanical spring configurations as energy storage devices, according to some embodiments of the invention.
Figure 3A:
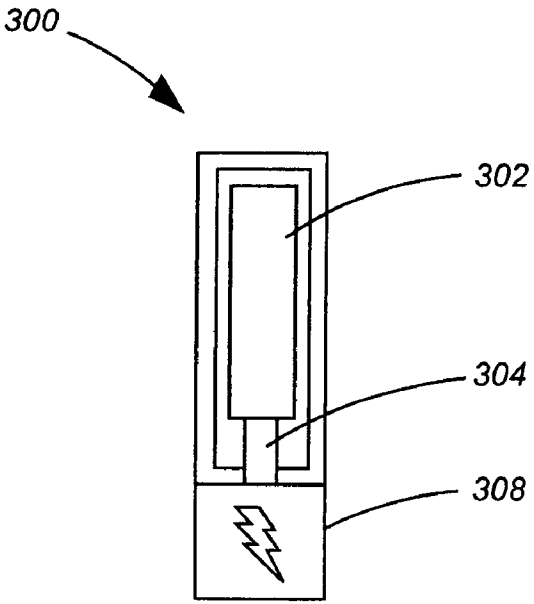

In some embodiments, the energy storage device 203 may be based on different types of mechanical spring configurations. FIGS. 3A-3B illustrate mechanical spring configurations as energy storage devices, according to some embodiments of the invention. FIG. 3A illustrates an energy storage device that includes a torsional power spring, according to some embodiments of the invention. In particular, FIG. 3A illustrates an energy storage device 300 that includes a torsional power spring 302 to store power. The torsional power spring 302 is coupled to a power source 308 through a drive shaft 304. Accordingly, the torsional power spring 302 may supply power to the power source 308 for powering components in the tool 100.

FIG. 3B illustrates an energy storage device that includes a compression spring, according to some embodiments of the invention. In particular, FIG. 3B illustrates an energy storage device 320 that includes a spring 322 within an exhaust chamber 324. The spring 322 is to store power. The spring 322 is coupled to a power source 328 through a hydraulic fluid 326. Accordingly, the spring 322 may supply power to the power source 328 for powering components in the tool 100.

Figure 4B:
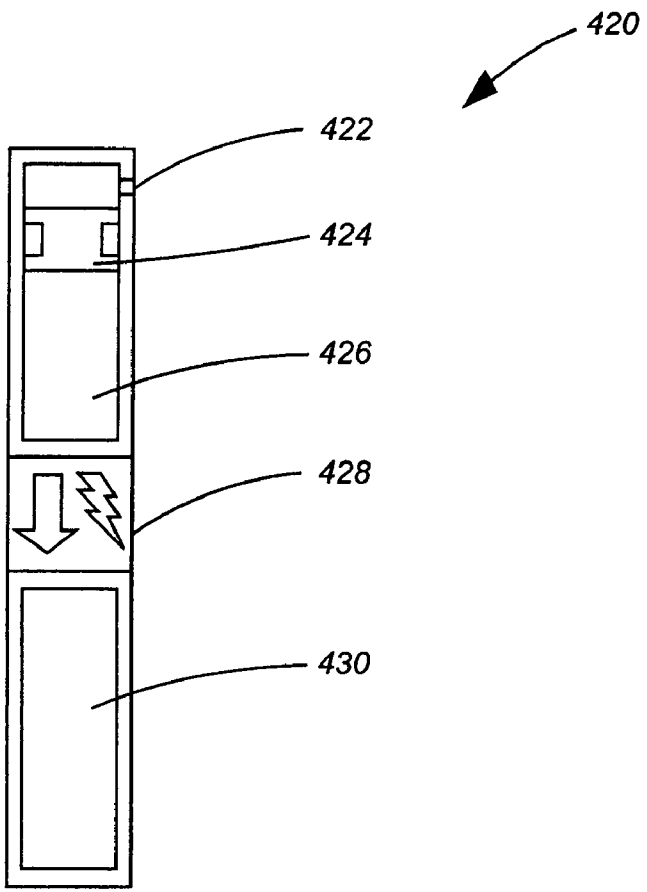
FIGS. 4A-4B illustrate hydrostatic chamber configurations as energy storage devices, according to some embodiments of the invention.
Figure 4A:
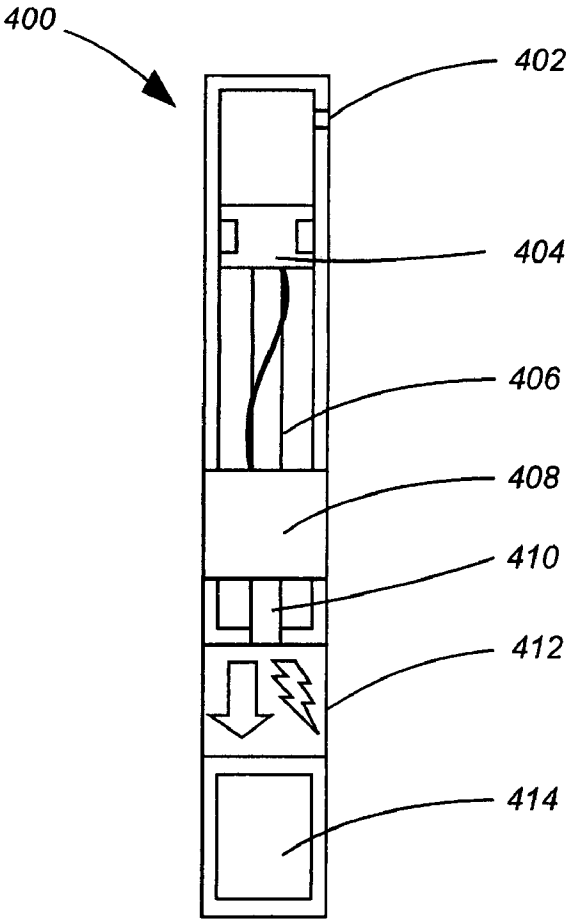

In some embodiments, the energy storage device 203 may be based on different types of hydrostatic chamber configurations. FIGS. 4A-4B illustrate hydrostatic chamber configurations as energy storage devices, according to some embodiments of the invention. FIG. 4A illustrates an energy storage device that includes a hydrostatically-driven mechanical system, according to some embodiments of the invention. In particular, FIG. 4A illustrates an energy storage device 400 that includes hydrostatic pressure 402. The hydrostatic pressure 402 is positioned adjacent to a drive piston 404 (that may be non-rotating). The energy storage device 400 also includes a torsion shaft 406 positioned adjacent to the drive piston 404 (opposite the hydrostatic pressure 402). The energy storage device 400 includes a speed increaser 406 positioned adjacent to the torsion shaft 406 (opposite the drive piston 404). The energy storage device 400 includes a drive shaft 410 positioned adjacent to the speed increaser 408 (opposite the torsion shaft 406). The energy storage device 400 includes a power source 412 positioned adjacent to the drive shaft 410 (opposite the speed increaser 408). The energy storage device 400 also includes an exhaust chamber 414 positioned adjacent to the power source 412 (opposite the drive shaft 410).

FIG. 4B illustrates an energy storage device that includes a hydrostatically-driven hydraulic system, according to some embodiments of the invention. In particular, FIG. 4B illustrates an energy storage device 420 that includes hydrostatic pressure 422. The hydrostatic pressure 422 is positioned adjacent to a piston 424 (that may be floating). The energy storage device 420 also includes a hydraulic fluid 426 that is positioned adjacent to the piston 424 (opposite the hydrostatic pressure 422). The energy storage device 420 includes a power source 428 that is positioned adjacent to the hydraulic fluid 426 (opposite the piston 424). The energy storage device 420 includes an exhaust chamber 430 that is positioned adjacent to the power source 428 (opposite the hydraulic fluid 426).

Figure 5B:
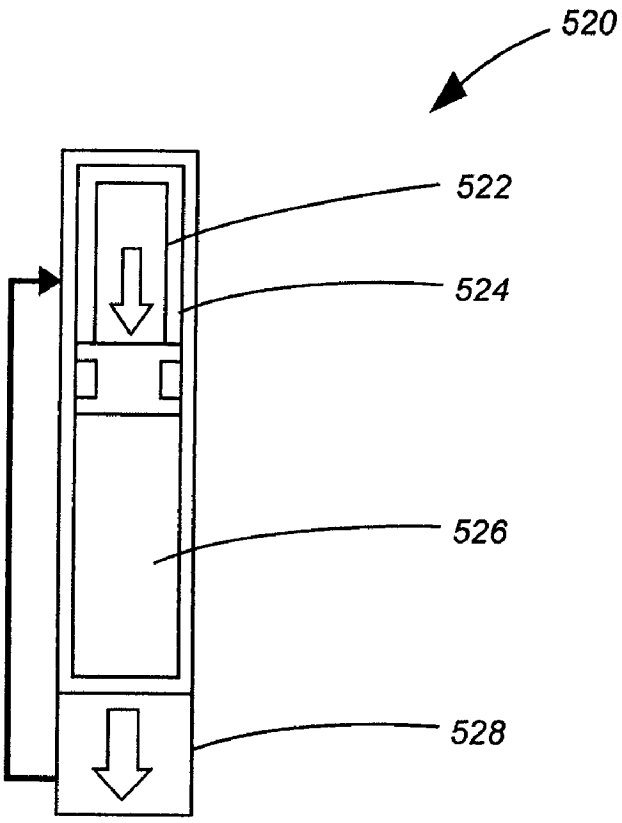
FIGS. 5A-5B illustrate elevated mass configurations as energy storage devices, according to some embodiments of the invention.
Figure 5A:
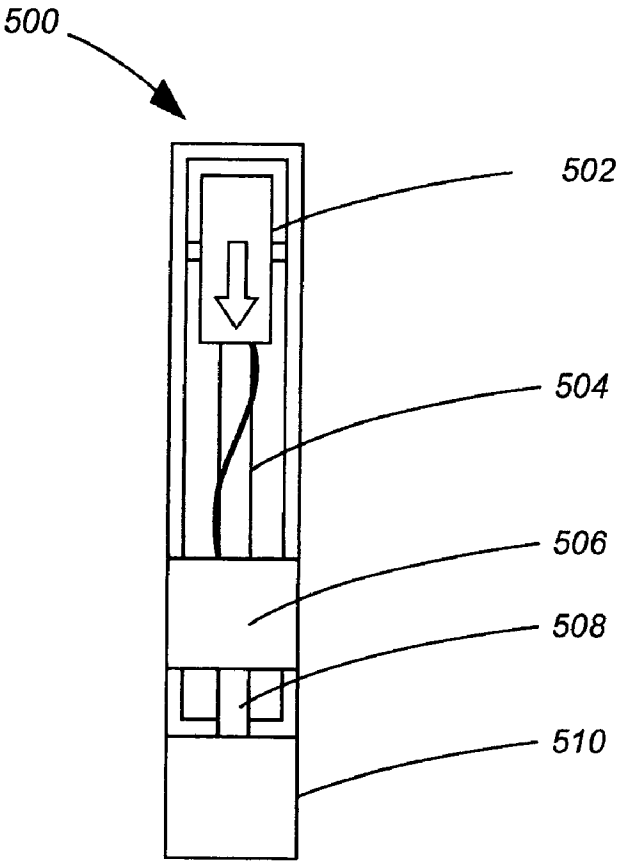

In some embodiments, the energy storage device 203 may be based on different types of elevated mass configurations. FIGS. 5A-5B illustrate elevated mass configurations as energy storage devices, according to some embodiments of the invention. FIG. 5A illustrates an energy storage device that includes a mass-driven mechanical system. In particular, FIG. 5A illustrates an energy storage device 500 that includes a mass 502. The mass 502 is positioned adjacent to a torsion shaft 504. The energy storage device 500 also includes a speed increaser 506 positioned adjacent to the torsion shaft 504 (opposite the mass 502). The energy storage device 500 also includes a drive shaft 508 positioned adjacent to the speed increaser 506 (opposite the torsion shaft 504). The energy storage device also includes a power source 510 positioned adjacent to the drive shaft 508 (opposite the speed increaser 506).

FIG. 5B illustrates an energy storage device that includes a mass-driven hydraulic system. In particular, FIG. 5B illustrates an energy storage device 520 that includes a mass 522 within an exhaust chamber 524. The exhaust chamber 524 is positioned adjacent to hydraulic fluid 526. The energy storage device 500 also includes a power source 528 positioned adjacent to the hydraulic fluid 526 (opposite the exhaust chamber 524).

Figure 6B:
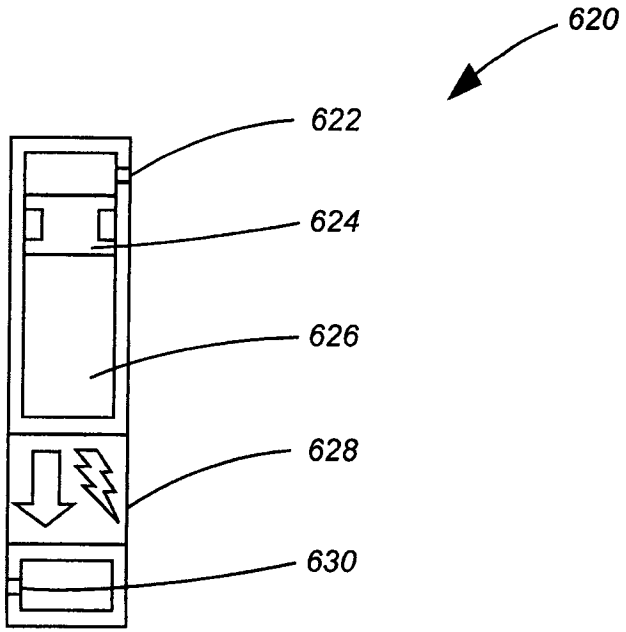
FIGS. 6A-6B illustrate differential pressure drive configurations as energy storage devices, according to some embodiments of the invention.
Figure 6A:
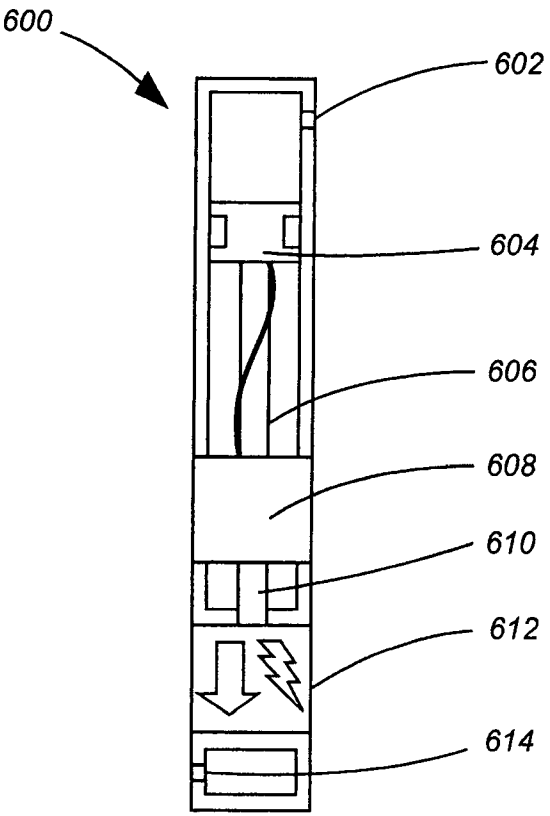

In some embodiments, the energy storage device 203 may be based on different types of differential pressure drive configurations. FIGS. 6A-6B illustrate differential pressure drive configurations as energy storage devices, according to some embodiments of the invention. FIG. 6A illustrates an energy storage device that includes a differential pressure-driven mechanical system. In particular, FIG. 6A illustrates an energy storage device 600 that includes an annulus pressure port 602. The annulus pressure port 602 is positioned adjacent to a drive piston 604 (which may be non-rotating). The energy storage device 600 also includes a torsion shaft 606 positioned adjacent to the drive piston 604 (opposite the annulus pressure port 602). The energy storage device 600 also includes a speed increaser 608 positioned adjacent to the torsion shaft 606 (opposite the drive piston 604). The energy storage device 600 also includes a drive shaft 610 positioned adjacent to the speed increaser 608 (opposite the torsion shaft 606). The energy storage device 600 also includes a power source 612 positioned adjacent to the drive shaft 610 (opposite the speed increaser 608). The energy storage device 600 includes a tubing pressure port 614 positioned adjacent to the power source 612 (opposite the drive shaft 610).

FIG. 6B illustrates an energy storage device that includes a differential pressure-driven hydraulic system. In particular, FIG. 6B illustrates an energy storage device 620 that includes an annulus pressure port 622. The annulus pressure port 622 is positioned adjacent to a piston 624 (which may be floating). The energy storage device 620 also includes hydraulic fluid 626 positioned adjacent to the piston 624 (opposite the annulus pressure port 622). The energy storage device 620 also includes a power source 628 positioned adjacent to the hydraulic fluid 626 (opposite the piston 624). The energy storage device 620 also includes a tubing pressure port 630 positioned adjacent to the power source 628 (opposite the hydraulic fluid 626).

Figure 7B:
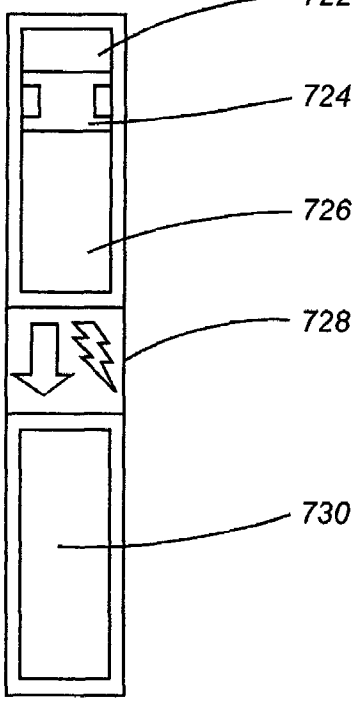
FIGS. 7A-7B illustrate compressed gas drive configurations as energy storage devices, according to some embodiments of the invention.
Figure 7A:
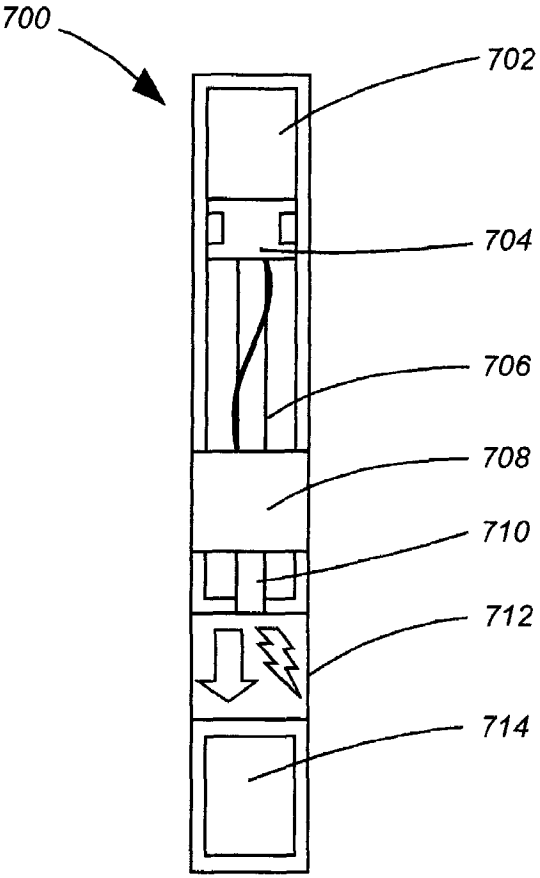

In some embodiments, the energy storage device 203 may be based on different types of compressed gas drive configurations. FIGS. 7A-7B illustrate compressed gas drive configurations as energy storage devices, according to some embodiments of the invention. FIG. 7A illustrates an energy storage device that includes a compressed gas-driven mechanical system. In particular, FIG. 7A illustrates an energy storage device 700 that includes an inert gas charge 702. The inert gas charge 702 is positioned adjacent to a drive piston 704 (which may be non-rotating). The energy storage device 700 also includes a torsion shaft 706 positioned adjacent to the drive piston 704 (opposite the inert gas charge 702). The energy storage device 700 also includes a speed increaser 708 positioned adjacent to the torsion shaft 706 (opposite the drive piston 704). The energy storage device 700 also includes a drive shaft 710 positioned adjacent to the speed increaser 708 (opposite the torsion shaft 706). The energy storage device 700 also includes a power source 712 positioned adjacent to the drive shaft 710 (opposite the speed increaser 708). The energy storage device 700 includes an exhaust chamber 714 positioned adjacent to the power source 712 (opposite the drive shaft 710).

FIG. 7B illustrates an energy storage device that includes a compressed gas-driven hydraulic system. In particular, FIG. 7B illustrates an energy storage device 720 that includes an inert gas charge 722. The inert gas charge 722 is positioned adjacent to a piston 724 (which may be floating). The energy storage device 720 also includes hydraulic fluid 726 positioned adjacent to the piston 724 (opposite the inert gas charge 722). The energy storage device 720 also includes a power source 728 positioned adjacent to the hydraulic fluid 726 (opposite the piston 724). The energy storage device 720 includes an exhaust chamber 730 positioned adjacent to the power source 728 (opposite the hydraulic fluid 726).

Therefore, as described, some embodiments provide a combination of low-temperature electrical components (such as those housed in the thermal barrier 106) with high-temperature electrical components (such as those that are part of the high-temperature power source 202, high-temperature power conditioning electronics 204, high-temperature telemetry 212, sensors 214, etc) for downhole operations.

Switchably Operated Downhole Power Source for Heating and Cooling

Figure 8:
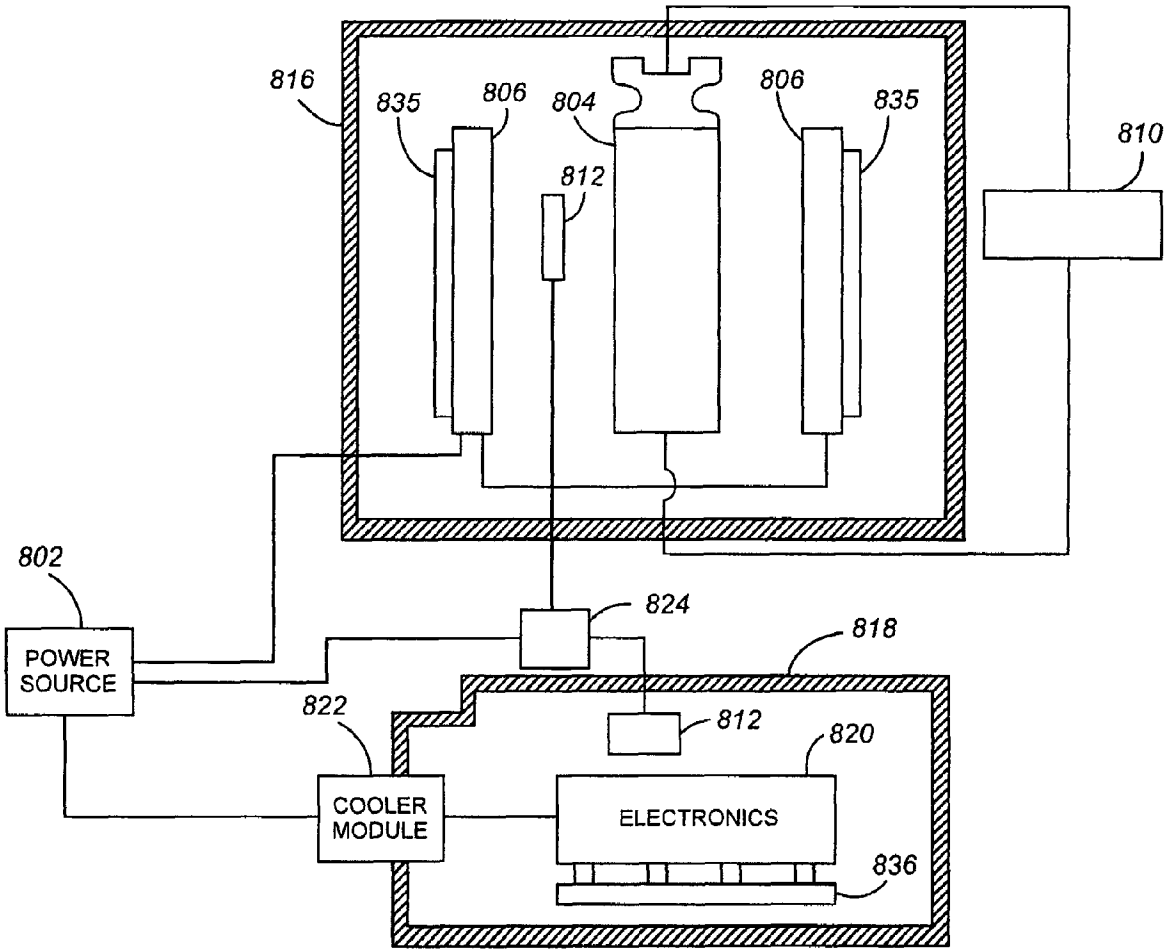
FIG. 8 illustrates a more detailed diagram of a tool for downhole operations that includes a configuration for controlling power flow between heating and cooling, according to some embodiments of the invention.

In some embodiments, a controller may be used to control the flow of power in the tool 100. FIG. 8 illustrates a more detailed diagram of a tool for downhole operations that includes a configuration for controlling power flow between heating and cooling, according to some embodiments of the invention. In particular, FIG. 8 illustrates a more detailed block diagram of parts of the tool 100. FIG. 8 includes a power source 802 coupled to a controller 824. The controller 824 is coupled to sensors 812. The controller 824 is also coupled to heaters 806 and a cooler module 822. The heaters 806 are thermally coupled to an energy storage device 804. The cooler module 822 is thermally coupled to the electronics 820. The thermal coupling may be through conduction, convection, radiation, etc. An optional thermal barrier 816 may also at least partially surround the heaters 806, the sensor 812 and the energy storage device 804. An optional thermal barrier 818 may also at least partially surround the cooler module 822, the electronics 820 and the sensor 812. The heaters 806 may be ohmic resistive heaters. The power source 802 and the cooler module 822 may be similar to the power source and the cooler module, illustrated in FIG. 2, respectively.

Optional heat sinks 835 may be thermally coupled to the heaters 806. The heat sinks 835 for the heaters 806 allows for heat energy to be given to the energy storage device 804 at times when energy is not be consumed by other components. For example, the heat may be given to the phase change material within the heat sinks 835 near the surface from a power source near the surface. The heat sinks 835 may supply heat to the energy storage device 804 during transit through the cold part of the borehole. Additionally, the heat sinks 835 coupled to the heaters 806 may increase the duration where the heaters 806 may remain off, thus providing additional time for using the electronics 820.

Figure 9:
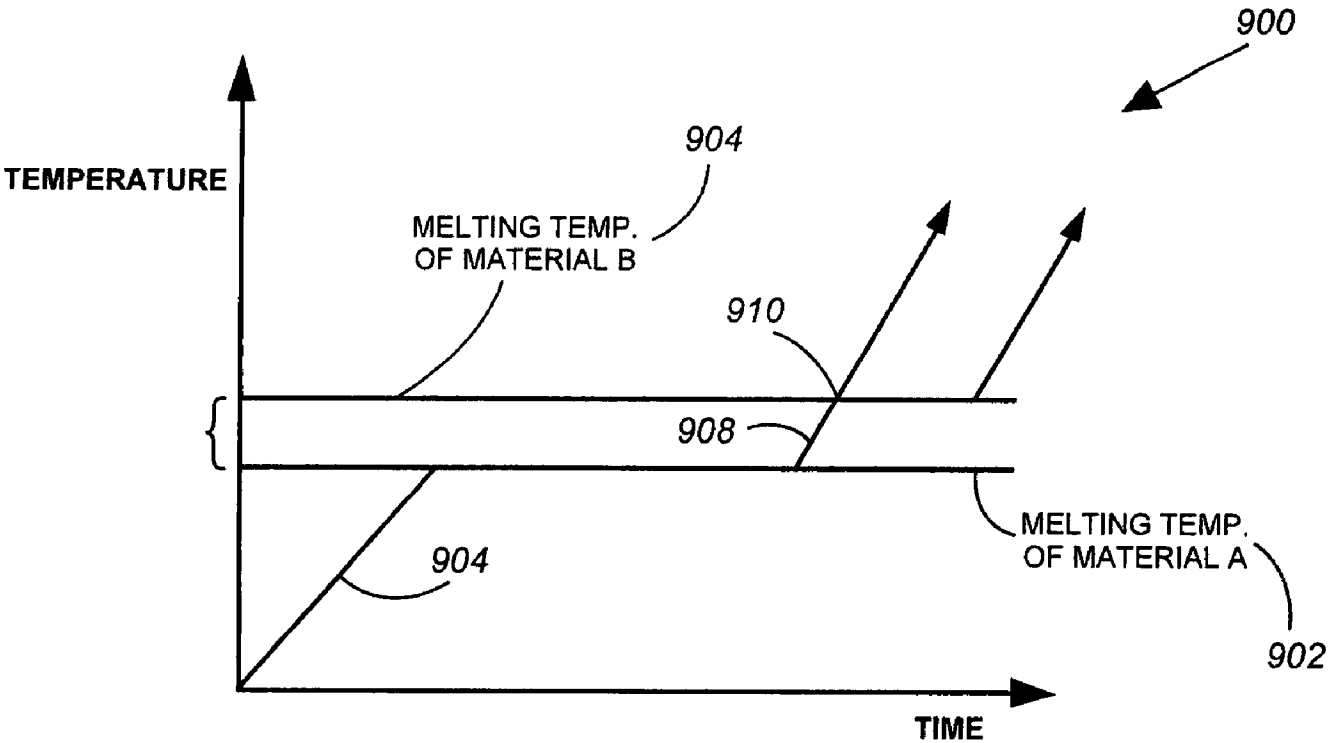
FIG. 9 illustrates a plot of the temperatures of two phase change materials as a function of time, according to some embodiments of the invention.

An optional heat sink 836 may be thermally coupled to the electronics 820. In some embodiments, the heat sink 835 and/or the heat sink 836 include a phase change material. In some embodiments, the heat sink 835 and/or the heat sink 836 include more than one phase change material. Such a heat sink may be used to trigger events based on the state of the phase change material. In some embodiments, the heat sinks 835/836 may be composed of two phase change materials. FIG. 9 illustrates a plot of temperature of two phase change materials within a heat sink as a function of time, according to some embodiments of the invention. As illustrated, a graph 900 includes temperature as a function of time for phase change material A and phase change material B. The melting temperature of material A (902) is lower than the melting temperature of material B (904). The temperature rises until a melting temperature of material A is reached (906). After the material A is melted, the temperature rises (908). The temperature rises until the melting temperature of material B is reached (910). This second plateau provides a warning that the two phase change materials in the heat sink are about to be exhausted.

For example, the impending exhaustion of the phase change material may trigger one or more events. An example of an event may be the turning down or off of high-powered devices to reduce the amount of heat generated. In another example, a given change in the phase change material may trigger a signal to the operator to exit the hole. For example, a change in the phase change material may represent an overheating downhole. Another example of an event may be a feedback indicator to the heater/cooler system that more or less power needs to be applied to increase or decrease the heating/cooling capability. Another example of an event may be an activation of an auxiliary or backup heating/cooling supply (such as an exothermal/endothermal chemical reaction). In some embodiments, the state of the phase change material may serve as a predictor of the performance of the system, diagnostic evaluation, etc. The temperature of the phase change material may be monitored to optimize the performance of the heating and/or cooling system.

While described with two phase change materials, a lesser or greater number of material may be used. If more parts are used, a more precise estimate of the usage of the heat sink may be obtained. In some embodiments, the parts of the phase change material are not miscible. The miscibility may be controlled by making the materials hydrophobic/hydrophilic, by making emulsions of the phase change materials. In some embodiments, if the phase change materials are mixed together, the materials may be physically separated. For example, one of the materials may be encapsulated in metal, plastic, glass, ceramic, etc. The phase change materials could both be placed in the voice space of a foam.

With reference to FIG. 9, the two phase change materials may be applied with a wide ΔT between the melting of material A and material B. In such a situation, the electrical components thermally coupled to the heat sink (e.g., the energy storage device 804 (shown in FIG. 8)) may be configured to operate in the temperature range between the melting temperature of material A and the melting temperature of material B. Thus, there is a heat sink, material A, to keep the electrical component cool enough for operation. There is also a heat sink, material B, to prevent the electrical component from over heating when the ambient temperature is too high, the thermostat on the heater failed, the internal heating from high power usage generated too much heat, etc. The composition of the heat sinks 835/836 is not limited to phase change material. For example, the heat sinks 835/836 may also be composed of various metals, such as copper, aluminum, etc.

Returning to FIG. 8, energy stored in the energy storage device 804 may be used to supply power to an electrical load 810, the heaters 806, the cooler module 822, the electronics 820, etc. The electrical load 810 may represent different electrical loads downhole. Referring to FIG. 2, for example, the electrical load 810 may include the sensors 214, the high-temperature telemetry 212, etc. The power source 802 may also supply power to the electrical load 810, the electronics 820, etc.

Moreover, the power source 802 may be switchably operated to provide power to both the heaters 806 and the cooler module 822. In some embodiments, at a low temperature, a greater percentage or all of the power from the power source 802 is supplied to the heaters 806. Conversely, at a high temperature, a greater percentage or all of the power from the power source 802 is supplied to the cooler module 822.

Power scheduling among the heating and cooling may allow for a smaller power generator. In particular, the total power for the simple sum of the loads may be larger than the power that can be provided by the power source 802. This is possible because in some embodiments, not all of the loads are used simultaneously. In some embodiments, the power source 802 derives power from the mud flow downhole. Power scheduling may allow for full operation at lower flow rates.

The controller 824 may be a direct wire connection, an inductive couple, a feedback controller, a feedforward controller, a pre-programmed timing-based controller, a neural network controller, an adaptive controller, etc. that allows power to flow between the power source 802 and the heaters 806, and the power source 802 and the cooler module 822. For example, in some embodiments, the controller 824 may be a pulse-width modulation controller that changes the pulse widths to adjust the duty cycle of the applied voltage.

The controller 824 is shown to control the distribution of power based on input from the sensors 812. The sensors 812 are shown to monitor the temperature of the energy storage device 804 and the electronics 820. Embodiments are not so limited. For example, the controller 824 may control based on input from either (and not necessarily both) of the sensors 812. Alternatively or in addition, the controller 824 may control based on another sensor (not shown) that is positioned to measure the ambient temperature downhole. Alternatively or in addition, the controller 824 may control based on the temperature of the phase change material within the heat sink 835 and/or the heat sink 836. In some embodiments, the heaters 806 and the cooler module 822 may adjust the amount of power to accept from the controller 824. For example, if the cooler module 822 does not need power for cooling, the cooler module 822 may include its own controller to adjust how much power to accept. Optional thermostats may be coupled to the heaters 806 and the cooler module 822. Control may be based on a temperature reference from the thermostats for the energy storage device 804/electronics 820 or for the heat sinks 835/836.

In some embodiments, the energy storage device 804 may be the thermal barrier 818. Accordingly, the energy storage device 804 may be such devices that are operable at low temperatures (such as a primary lithium battery). In some embodiments, the tool may include multiple energy storage devices where one or more may be positioned outside the thermal barrier 818 and one or more may be housed in the thermal barrier 818. In some embodiments, the heat sink 836 may be positioned between the cooler module 822 and the electronics 820. In one such configuration, the heat sinks 835 may be absent.

Figure 10:
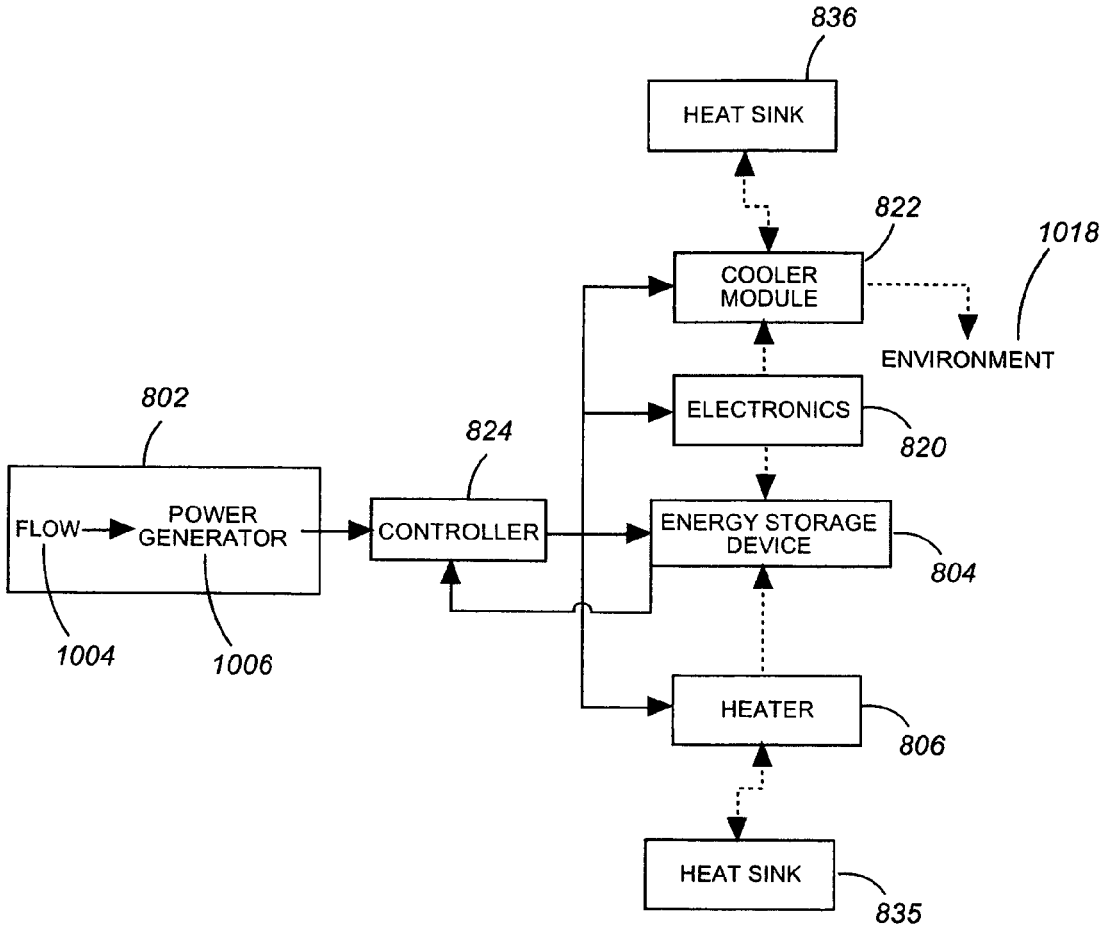
FIG. 10 illustrates power and heat flow in a tool for downhole operations that includes a configuration for controlling power flow between heating and cooling, according to some embodiments of the invention.

FIG. 10 illustrates power and heat flow in a tool for downhole operations that includes a configuration for controlling power flow between heating and cooling, according to some embodiments of the invention. The power flow and the heat flow are illustrated by the solid lines and dashed lines, respectively. The power source 802 is represented as a turbine 1006 that receives power from a flow 1004 of mud downhole.

The controller 824 is coupled to receive power from the turbine 1006. The controller 824 is coupled to switchably supply power to the cooler module 822 and the heaters 806. The controller 824 is also coupled to switchably supply power to the electronics 820 and the energy storage device 804. In some embodiments, power may be supplied to the electronics 820 and the energy storage device 804 simultaneously or to either.

The controller 824 may be configured to receive power from multiple sources. For example, the controller 824 may receive power from a generator and an energy storage device. Power from the generator may be allocated to and by the controller 824 in varying proportion to any or all of the energy storage device 804, cooler module 822, the electronics 820, the heaters 806, the electronics 820 (including sensors) and the controller 824. In some embodiments, power from the energy storage device 804 may be allocated to and by the controller 824 in varying proportion to the electronics 820 (including sensors). It is possible that power from the energy storage device 804 may be allocated to the cooler module 822 or heaters 806 for a short period of time.

With regard to heat flow, heat may be exchanged between the heat sink 836 and the cooler module 822. Heat may also be exchanged between the heat sink 835 and the heaters 8806. Heat may also flow from the electronics 820 to the cooler module 822 and to the energy storage device 804. Heat may also flow from the cooler module 822 to the environment 418 and to the heaters 806. Heat may also flow from the heaters 806 to the energy storage device 804.

The heat flow and power flows are not limited to those shown in FIG. 10. For example, with regard to heat flow, the direction is dependent on the relative temperatures. In some embodiments, heat flows between the electronics 820 and the heat sink 836, between the heat sink 836 and the cooler module 822, and between the cooler module 822 and the environment 418. Heat may also flow between the heaters 806 and the energy storage device 804.

Figure 11:
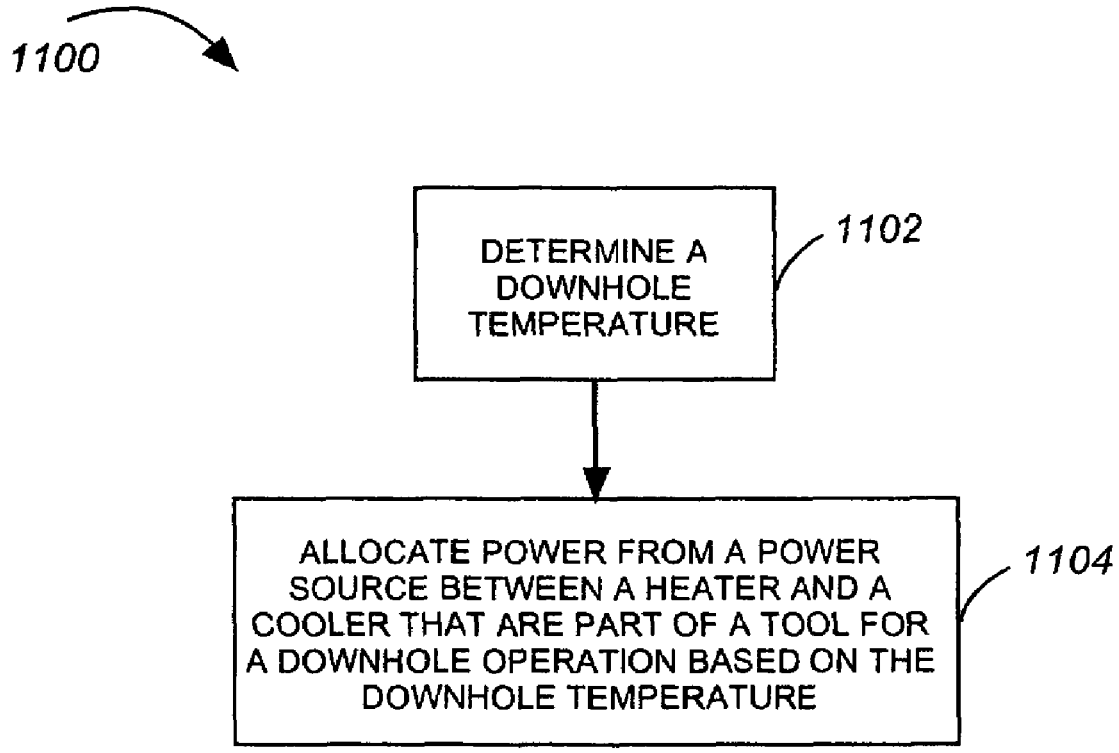
FIG. 11 illustrates a flow diagram for controlling power flow between heating and cooling, according to some embodiments of the invention.

The operations of the configuration illustrated in FIG. 8 are now described. In particular, FIG. 11 illustrates a flow diagram for controlling power flow between heating and cooling, according to some embodiments of the invention. The flow diagram commences at block 1102.

At block 1102, a downhole temperature (or alternatively a rate of change of the downhole temperature) is determined. With reference to FIG. 8, the controller 824 may make this determination. The controller 824 may make this determination based on data from one of more of the sensors downhole. For example, the controller 824 may determine the temperatures of the environment external or internal to the tool. The controller 824 may determine the temperatures of the energy storage device 804 and/or the electronics 820. The controller 824 may also determine a temperature of one or more phase change materials within one of more of the heat sinks (e.g., the heat sink 835 or the heat sink 836). The flow continues at block 1104.

At block 1104, power from a power source is allocated between a heater and a cooler that are part of a tool used for a downhole operation based on the downhole temperature. With reference to FIG. 8, the controller 824 may make this allocation. The controller 824 may allocate different percentages, all and none, etc. based on the downhole temperature. For example, if the downhole temperature is below a minimum value, the controller 824 may allocate all power to the heaters 806. If the downhole temperature is above the minimum value but below a threshold value, the controller 824 may allocate a higher percentage of the power to the heaters 806. If the downhole temperature is above the threshold value, the controller 824 may allocate all of the power to the cooler module 822. In some embodiments, the controller 824 may allocate a preponderance of the power to the heaters 806, if the downhole temperature is defined as low. The controller 824 may allocate a preponderance of the power to the cooler module 822, if the downhole temperature is defined high. For example, a low temperature may be defined as a temperature less than 100° C.; a high temperature may be defined as a temperature of 100° C. or greater. Therefore, the controller 824 may allocate power between the heater and cooler using a number of different techniques. While described such that allocation is between the heaters and the cooler module, embodiments are not so limited. For example, the controller 824 may allocate power to other components of the tool. In particular, the controller 824 may allocate power between the heaters 806, the cooler module 822, the electronics 820, the heat sinks 836, the heat sink 835, etc.

Downhole Rechargeable Energy Storage Device

In some embodiments, rechargeable energy storage devices are used to power electrical components downhole. For example, with reference to FIGS. 2 and 8, the energy storage device 203/804 may be rechargeable. The rechargeable energy storage devices may be charged by a downhole power source. For example, a turbine generator may be used to recharge the rechargeable energy storage devices. In some embodiments, the rechargeable energy storage devices may be charged at the surface. In other words, the rechargeable energy storage device is being charged prior to be placed in the well. In some embodiments, the rechargeable energy storage devices may be different types of batteries (such as molten salt batteries). The rechargeable energy storage devices may be operable at high temperatures. High temperatures at which the rechargeable energy storage devices may be operable include temperature above 60°C., above 120° C., above 175° C., above 220° C., above 600° C., in a range of 175-250° C., in a range of 220-600° C., etc. Below these temperatures, the rechargeable energy storage devices may provide electrical power but are defined as "not operable" due to an increase in internal resistance, a reduction in capacity, a reduction in cycle life, or some other temperature-dependent behavior. In some embodiments, the rechargeable energy storage devices may be operable at low temperatures. The low temperature at which the rechargeable energy storage devices are operable includes temperature below 100° C., below 150° C., below 175° C., below 200° C., below 220° C., below 125° C., below 100° C., below 80° C., in a range of 0-80° C., in a range of −20-100° C., etc. At higher temperatures, these rechargeable energy storage devices may provide electrical power but are defined as "not operable" due to an increase in self discharge, a reduction in cycle life, a reduction in current output, a decrease in safety, or some other temperature-dependent behavior.

The energy storage device and the rechargeable energy storage device may store energy in electro-chemical reactions, such as batteries, capacitors, and fuel cells. The energy storage device and rechargeable energy storage device may store energy in mechanical potential energy, such as springs and hydraulic assemblies, or in mechanical kinetic energy, such as flywheels and oscillating assemblies.

The electrical components downhole may be powered by a combination of a power source (such as a turbine generator powered by the flow of mud downhole), a vibration-based power generator powered by vibrations of the tool string, a vibration-based power generator powered by fluid-induced vibrations, a nuclear power source powered by atomic decay, a hydraulic accumulator-based power source, a gas accumulator-based power source, a flywheel-based power source, a hydrostatic dump chamber-based power source, and one or more rechargeable energy storage devices. An example of such a configuration is illustrated in FIG. 2. For example, the electrical components may be powered directly by the power generator while there is a sufficient fluid flow. Power not consumed by the electrical components may be used to charge the one or more rechargeable energy storage devices. During no flow condition, all or some of the electrical components may be powered by the one or more rechargeable energy storage devices. For example, when drill stands are being changed (no fluid flow), the cooling system and/or heaters may be switched off and power for select sensors and/or electronics may be supplied by the rechargeable energy storage devices.

Figure 12:
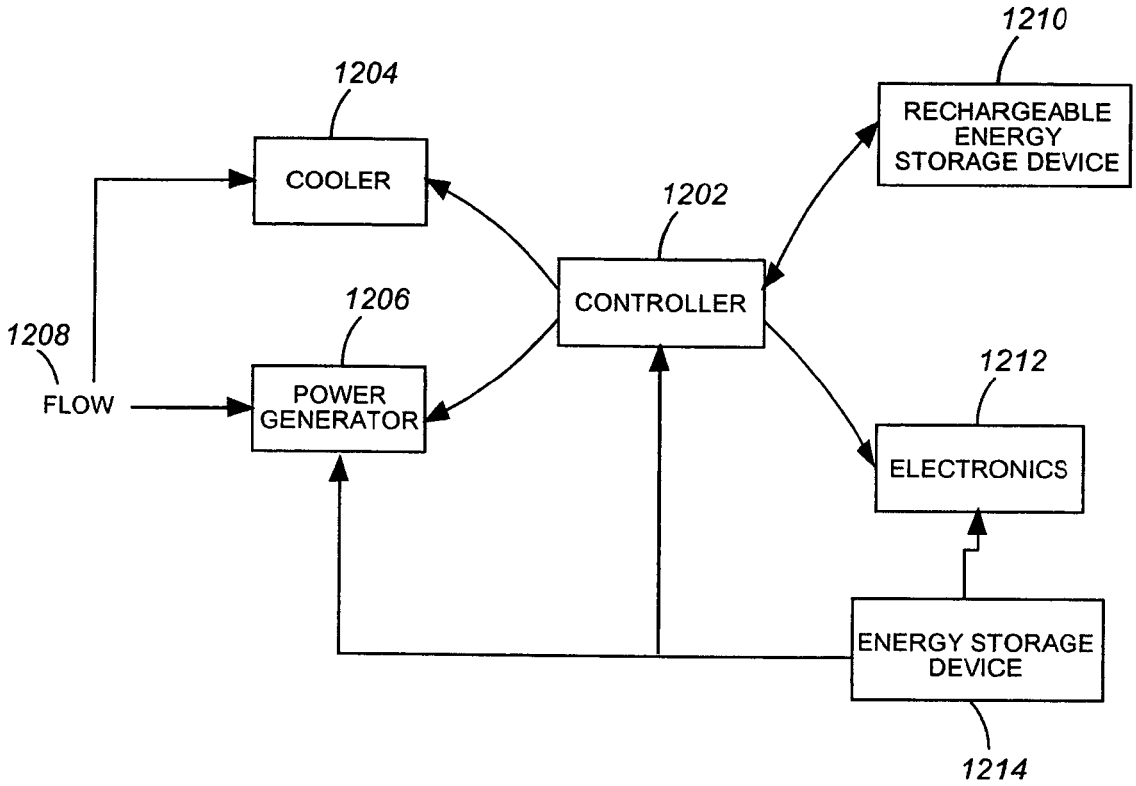
FIG. 12 illustrates power flow in a tool for downhole operations that includes a rechargeable energy storage device, according to some embodiments of the invention.
Figure 13:
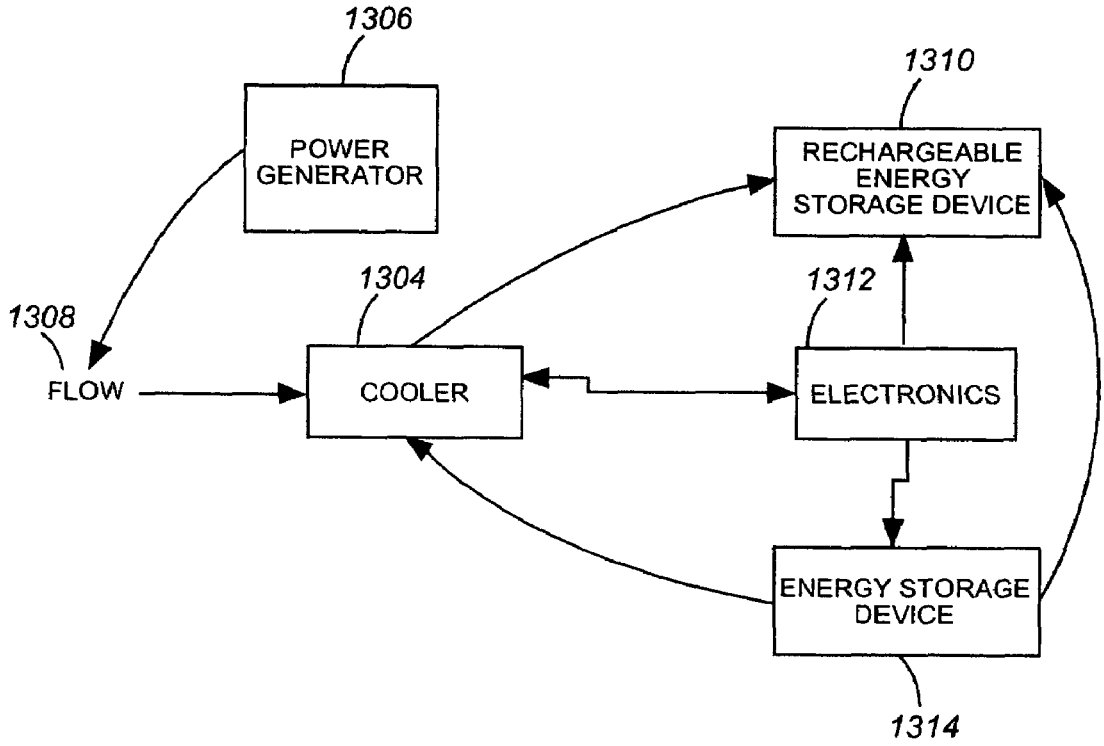
FIG. 13 illustrates heat flow in a tool for downhole operations that includes a rechargeable energy storage device, according to some embodiments of the invention. Heat flows from a turbine generator 806 and a cooler 804 to a mud flow 808.

Some embodiments use a controller (similar to the one shown in FIG. 8) to control power distribution from among a power generator, a rechargeable energy storage device and an energy storage device. Accordingly, the controller serves as a power hub to direct power from the power generator, the rechargeable energy storage device, and the energy storage device to the different electrical loads downhole. FIGS. 12 and 13 illustrate power flow and heat flow, respectively, for parts of a tool that includes a rechargeable energy storage device, according to some embodiments of the invention. In particular, FIG. 12 illustrates power flow in a tool for downhole operations that includes a rechargeable energy storage device, according to some embodiments of the invention.

As shown, a power generator 1206 and a cooler 1204 receive power from a flow 1208. A controller is coupled to receive power from the power generator 1206, a rechargeable energy storage device 1210 and an energy storage device 1214. The controller 1202 distributes power to the cooler 1204 and the electronics 1212. Accordingly, the cooler 1204 may receive power directly from the flow 1208 or from the controller 1202. The energy storage device 1214 may also be coupled to supply power to the power generator 1206. The controller 1202 may also distribute power from the power generator 1206 and the energy storage device 1214 to the rechargeable energy storage device 1210.

FIG. 13 illustrates heat flow in a tool for downhole operations that includes a rechargeable energy storage device, according to some embodiments of the invention. Heat may flow from a power generator 1306 and a cooler 1304 to a mud flow 1308. Heat is exchanged between the cooler 1304 and a rechargeable storage device 1310. Heat may also be exchanged between the cooler 1304 and an energy storage device 1314. Accordingly, the heat from the cooler 1304 may increase the efficiency of the rechargeable storage device 1310 and the energy storage device 1314 (especially if such devices are operable at high-temperatures). Alternatively, the cooler 1304 may provide additional cooling to the rechargeable storage device 1310 and the energy storage device 1314 when the ambient temperature exceeds a maximum operating temperature for such devices. Heat may be exchanged between the cooler 1304 and electronics 1312. Accordingly, the cooler 1304 provides cooling to the electronics 1312 by accepting heat there from. The cooler 1304 may also provide heat to the electronics 1312 if a constant temperature reference is needed. Heat may be exchanged between the rechargeable energy storage device 1310 and the energy storage device 1314. Heat flows from electronics 1312 to the rechargeable energy storage device 1310 and the energy storage device 1314.

Figure 14A:
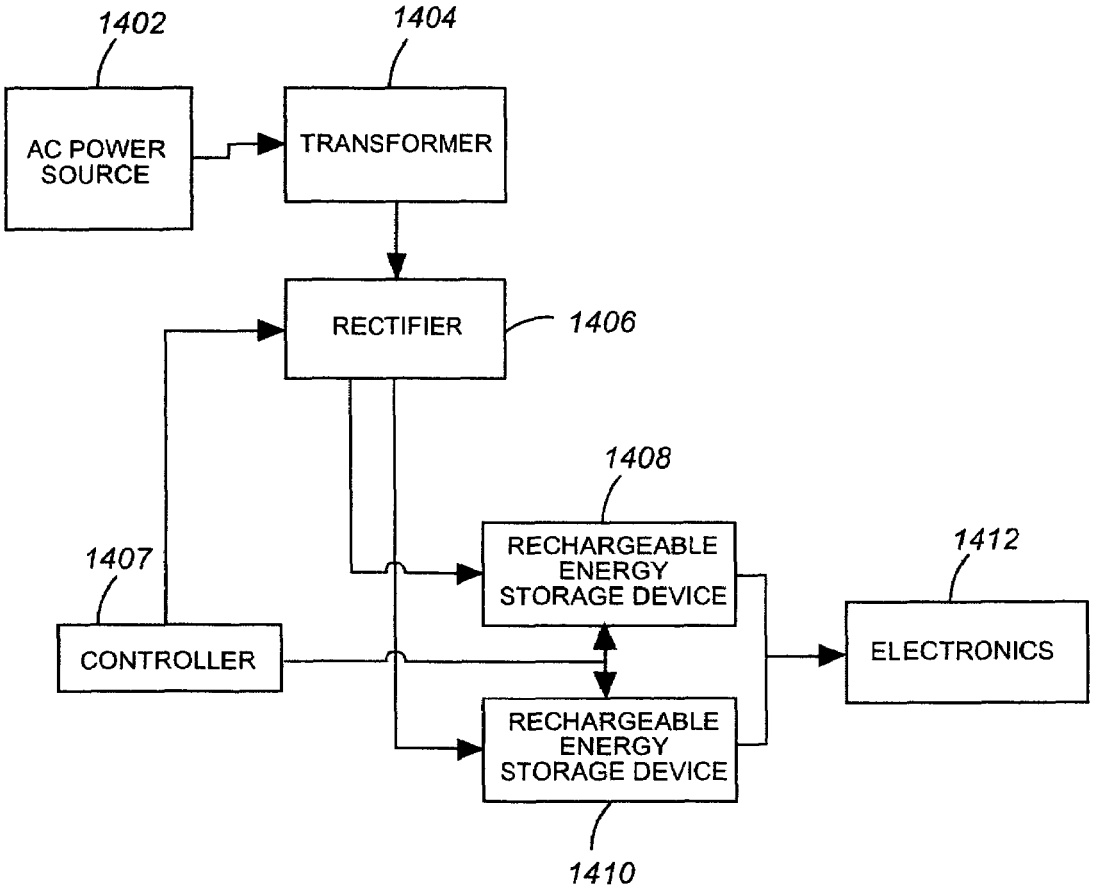
FIG. 14A illustrates a more detailed diagram of a tool for downhole operations that includes rechargeable energy storage devices to supply power downhole, according to some embodiments of the invention.
Figure 14B:
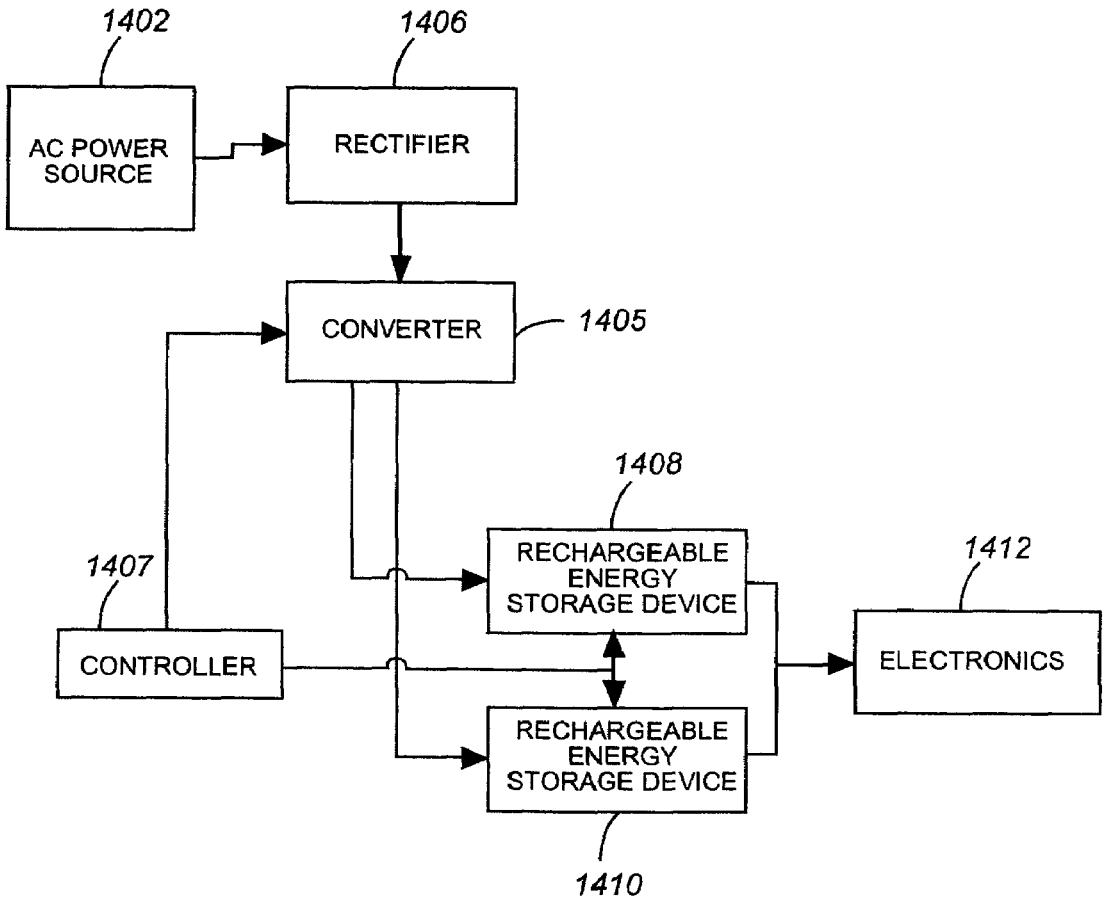
FIG. 14B illustrates a more detailed diagram of a tool for downhole operations that includes rechargeable energy storage devices to supply power downhole, according to other embodiments of the invention.

DC power sources (such as the rechargeable energy storage devices) may provide a cleaner source of power to electrical components in comparison to AC power sources. Therefore, in some embodiments, the turbine generator (or other AC power source downhole) may be used to recharge the rechargeable energy storage devices, which then power the electrical components. In other words, in such a configuration, the power generator is not used to directly supply power to the electrical components. FIGS. 14A and 14B illustrates different types of such configurations. FIG. 14A illustrates a more detailed diagram of a tool for downhole operations that includes rechargeable energy storage devices to supply power downhole, according to some embodiments of the invention. An AC power source 1402 may receive mechanical power from the fluid flow or drill string motion and may convert the mechanical power into electrical power. The AC power source 1402 may be any type of power generator (such as a turbine generator, as described above).The electrical power from the AC power source 1402 may be received by a transformer 1404. 14The transformer 1404 steps up or steps down the alternating current from the AC power source 1402. The transformed current from the transformer 1404 may be coupled to be input into a rectifier 1406. The rectifier 1406 converts the current into a DC current, which may then be used to recharge the rechargeable energy storage device 1408 and the rechargeable energy storage device 1410. The rechargeable energy storage device 1408 and the rechargeable energy storage device 1410 may supply DC power to electronics 1412. A controller 1407 may be coupled to the rectifier 1406, the rechargeable energy storage device 1408 and the rechargeable energy storage device 1410. The controller 807 controls which of the rechargeable energy storage devices is being recharged and which of the rechargeable energy storage devices is supplying power to the electronics 1412. Accordingly, DC current power source may be used to supply power to the electronics 1412 based on an AC current power source. In some embodiments, as one rechargeable energy storage device is being recharged, the other may be being used to supply power to the electronics downhole. The controller 1407 may control the switching based on amount of energy storage in each of the devices. For example, if the rechargeable energy storage device 1408 is supplying power and is almost deplete of stored energy, the controller 1407 may switch such that the rechargeable energy storage device 1410 is supplying power while the rechargeable energy storage device is being recharged.

FIG. 14B illustrates a more detailed diagram of a tool for downhole operations that includes rechargeable energy storage devices to supply power downhole, according to other embodiments of the invention. FIG. 14B has a similar configuration as FIG. 14A. However, the rectifier 1406 first receives the power from the AC power source 1402. A converter 1405 is coupled to receive the DC power from the rectifier 1406. The converter 1405 may perform a DC-to-DC step-up conversion to raise the DC voltage. 14While FIGS. 14A-14B are described in reference to an AC power source, embodiments are not so limited. The tool shown in FIGS. 14A-14B may include any other type of power.

Embodiments illustrated herein may be combined in various combinations. For example, the configuration of FIG. 8 (having the controller 824 for switching between heating and cooling) may be combined with the configurations of FIGS. 14A-14B (having an AC power source in combination with multiple rechargeable energy storage devices).

System Operating Environments

Figure 15A:
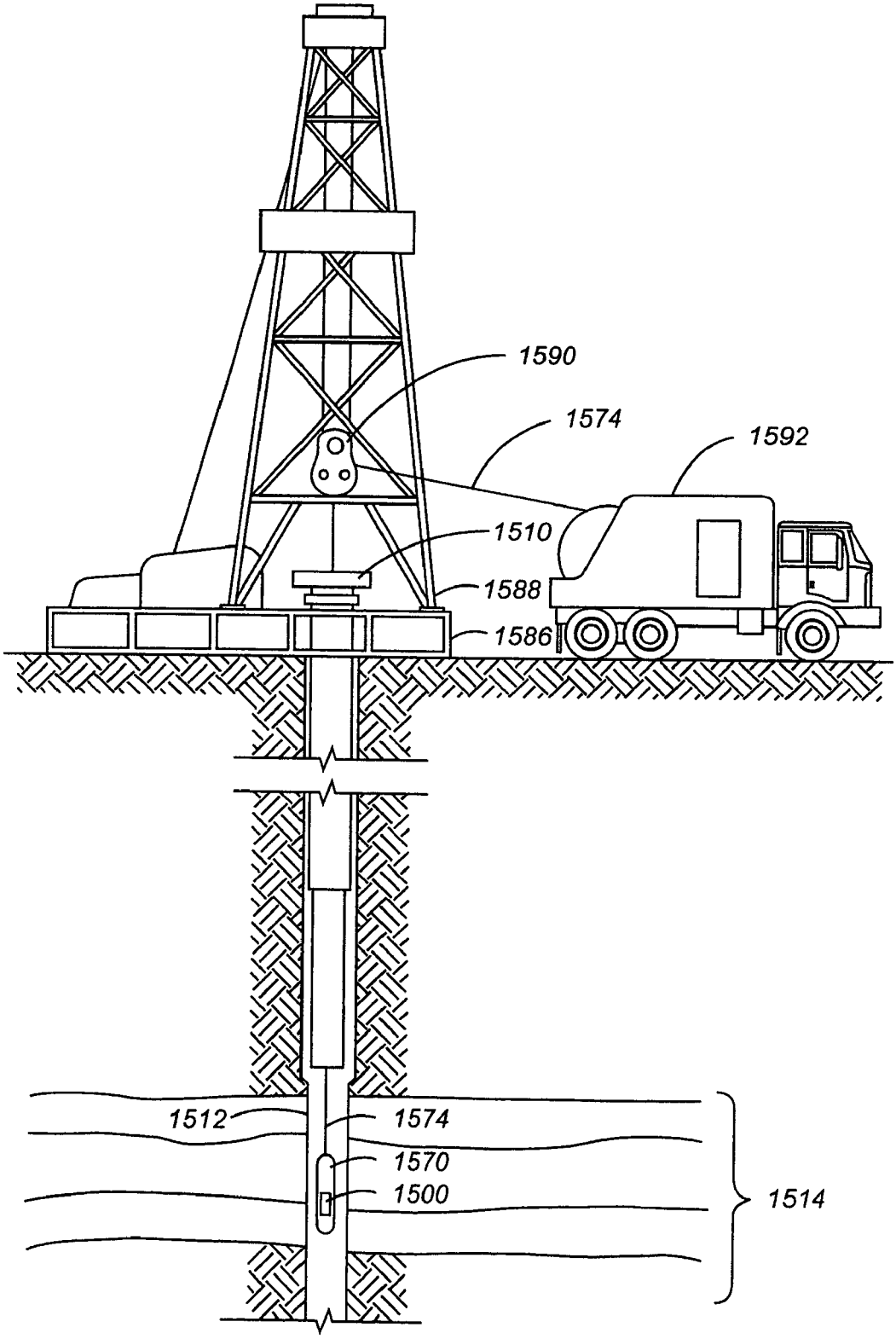
FIG. 15A illustrates a drilling well during wireline logging operations that includes the heating and/or cooling downhole, according to some embodiments of the invention.

System operating environments for the tool 100, according to some embodiments, are now described. FIG. 15A illustrates a drilling well during wireline logging operations that includes the heating and/or cooling downhole, according to some embodiments of the invention. A drilling platform 1586 is equipped with a derrick 1588 that supports a hoist 1590. Drilling of oil and gas wells is commonly carried out by a string of drill pipes connected together so as to form a drilling string that is lowered through a rotary table 1510 into a wellbore or borehole 1512. Here it is assumed that the drilling string has been temporarily removed from the borehole 1512 to allow a wireline logging tool body 1570, such as a probe or sonde, to be lowered by wireline or logging cable 1574 into the borehole 1512. Typically, the tool body 1570 is lowered to the bottom of the region of interest and subsequently pulled upward at a substantially constant speed. During the upward trip, instruments included in the tool body 1570 may be used to perform measurements on the subsurface formations 1514 adjacent the borehole 1512 as they pass by. The measurement data can be communicated to a logging facility 1592 for storage, processing, and analysis. The logging facility 1592 may be provided with electronic equipment for various types of signal processing. Similar log data may be gathered and analyzed during drilling operations (e.g., during Logging While Drilling, or LWD operations).

Figure 15B:
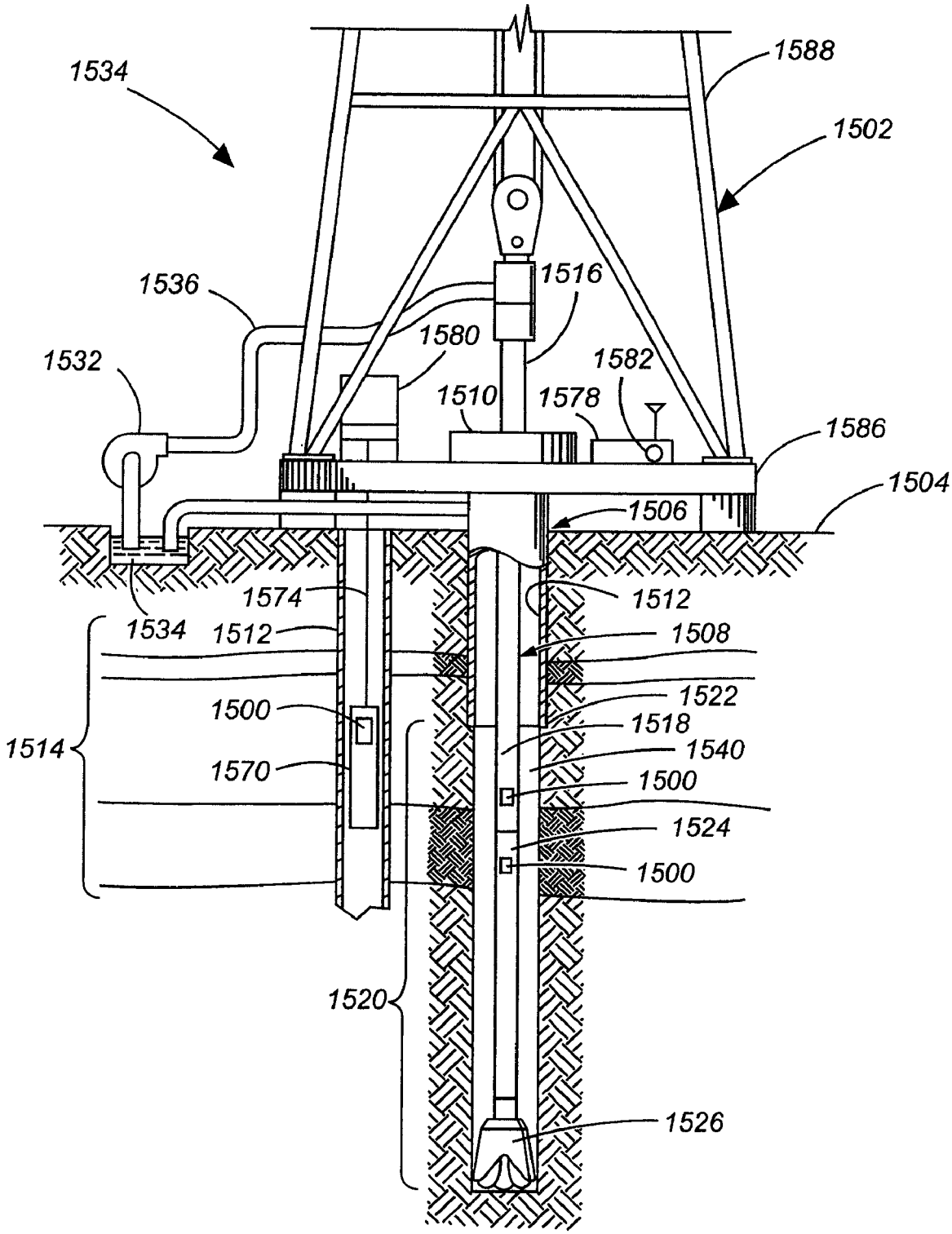
FIG. 15B illustrates a drilling well during MWD operations that includes the heating and/or cooling downhole, according to some embodiments of the invention.

FIG. 15B illustrates a drilling well during MWD operations that includes the heating and/or cooling downhole, according to some embodiments of the invention. It can be seen how a system 1564 may also form a portion of a drilling rig 1502 located at a surface 1504 of a well 1506. The drilling rig 1502 may provide support for a drill string 1508. The drill string 1508 may operate to penetrate a rotary table 1510 for drilling a borehole 1512 through subsurface formations 1514. The drill string 1508 may include a Kelly 1516, drill pipe 1518, and a bottom hole assembly 1520, perhaps located at the lower portion of the drill pipe 1518.

The bottom hole assembly 1520 may include drill collars 1522, a downhole tool 1524, and a drill bit 1526. The drill bit 1526 may operate to create a borehole 1512 by penetrating the surface 1504 and subsurface formations 1514. The downhole tool 1524 may comprise any of a number of different types of tools including MWD (measurement while drilling) tools, LWD (logging while drilling) tools, and others.

During drilling operations, the drill string 1508 (perhaps including the Kelly 1516, the drill pipe 1518, and the bottom hole assembly 1520) may be rotated by the rotary table 1510. In addition to, or alternatively, the bottom hole assembly 1520 may also be rotated by a motor (e.g., a mud motor) that is located downhole. The drill collars 1522 may be used to add weight to the drill bit 1526. The drill collars 1522 also may stiffen the bottom hole assembly 1520 to allow the bottom hole assembly 1520 to transfer the added weight to the drill bit 1526, and in turn, assist the drill bit 1526 in penetrating the surface 1504 and subsurface formations 1514.

During drilling operations, a mud pump 1532 may pump drilling fluid (sometimes known by those of skill in the art as "drilling mud") from a mud pit 1534 through a hose 1536 into the drill pipe 1518 and down to the drill bit 1526. The drilling fluid can flow out from the drill bit 1526 and be returned to the surface 1504 through an annular area 1540 between the drill pipe 1518 and the sides of the borehole 1512. The drilling fluid may then be returned to the mud pit 1534, where such fluid is filtered. In some embodiments, the drilling fluid can be used to cool the drill bit 1526, as well as to provide lubrication for the drill bit 1526 during drilling operations. Additionally, the drilling fluid may be used to remove subsurface formation 1514 cuttings created by operating the drill bit 1526.

General

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. In other instances, control structures, gate level circuits and full software instruction sequences have not been shown in detail in order not to obscure the embodiments of the invention. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

A number of figures show block diagrams of systems and apparatus for heating and cooling downhole, in accordance with some embodiments of the invention. A figure shows a flow diagram illustrating operations for heating and cooling downhole, in accordance with some embodiments of the invention. The operations of the flow diagram are described with references to the systems/apparatus shown in the block diagrams. However, it should be understood that the operations of the flow diagram could be performed by embodiments of systems and apparatus other than those discussed with reference to the block diagrams, and embodiments discussed with reference to the systems/apparatus could perform operations different than those discussed with reference to the flow diagram.

Some or all of the operations described herein may be performed by hardware, firmware, software or a combination thereof. For example, the operations of the different controllers as described herein may be performed by hardware, firmware, software or a combination thereof. Upon reading and comprehending the content of this disclosure, one of ordinary skill in the art will understand the manner in which a software program can be launched from a machine-readable medium in a computer-based system to execute the functions defined in the software program. One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well-known to those skilled in the art, such as application program interfaces or inter-process communication techniques, including remote procedure calls. The teachings of various embodiments are not limited to any particular programming language or environment.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. An apparatus comprising:

a tool for a downhole operation, the tool including, one or more electrical components;

first and second rechargeable energy storage devices, each energy storage device to supply power to the electrical components;

a generator to supply power to the rechargeable energy storage devices; and a controller to selectively supply power to recharge the first energy storage device while the second energy storage device supplies power to the one or more electrical components, and to selectively provide power to recharge the second energy storage device while the first energy storage device supplies power to the one or more electrical components.

2. The apparatus of claim 1, wherein each of the first and second rechargeable energy storage devices is a Direct Current power source, and wherein the generator is an Alternating Current power source.

3. The apparatus of claim 1, wherein each of the first and second rechargeable energy storage devices is operable at a high temperature.

4. The apparatus of claim 1, wherein at least one electrical component is not operable at a high temperature.

5. The apparatus of claim 4, wherein the at least one electrical component is not operable at above 175 degrees Celsius.

6. The apparatus of claim 1, wherein each of the first and second rechargeable energy storage devices comprises a battery, a capacitor, a fuel cell or a mechanical energy storage device.

7. An apparatus comprising:

a tool for a downhole operation, the tool including, an electrical component;

a first direct current (DC) rechargeable energy storage device coupled to the electrical component;

a second DC rechargeable energy storage device coupled to the electrical component; and an alternating current (AC) power source to charge the first DC rechargeable energy storage device while the second DC rechargeable energy storage device is to supply power to the electrical component and wherein the AC power source is to charge the second DC rechargeable energy storage device while the first DC rechargeable energy storage device is to supply power to the electrical component.

8. The apparatus of claim 7, wherein the AC power source comprises a generator powered based on a fluid flow.

9. The apparatus of claim 7, wherein the first DC energy storage device is operable at a high temperature.

10. A method comprising:

operating a tool downhole, the operating comprising, performing the following operations during a first time period, powering an electrical component with a first rechargeable energy storage device; and charging a second rechargeable energy storage device with an alternating current (AC) power source; and performing the following operations during a second time period, powering the electrical component with the second rechargeable energy storage device; and charging the first rechargeable energy storage device with the AC power source.

11. The method of claim 10, wherein the AC power source comprises a turbine generator powered based on a flow of mud downhole.

12. The method of claim 10, wherein the first energy storage device is operable at a high temperature.

13. The method of claim 12, wherein the high temperature is above 175 degrees Celsius.

14. The method of claim 10, wherein the first energy storage device and the second DC energy storage device are operable at a high temperature.

15. The method of claim 14, wherein the high temperature is above 175 degrees Celsius.

16. The method of claim 10, wherein operating the tool downhole further comprises measuring a downhole parameter with a sensor having a different electrical component operable at a high temperature and coupled to the electrical component.

* * * * *